US007374356B2

(12) United States Patent
Oike

(10) Patent No.: US 7,374,356 B2
(45) Date of Patent: May 20, 2008

(54) DOUBLE-HEAD WRITING INSTRUMENT

(75) Inventor: Shigeru Oike, Aichi (JP)

(73) Assignee: The Pilot Ink Co., Ltd., Aichi (JP)

( * ) Notice: Subject to any disclaimer, the term of this patent is extended or adjusted under 35 U.S.C. 154(b) by 399 days.

(21) Appl. No.: 11/012,069

(22) Filed: Dec. 15, 2004

(65) Prior Publication Data

US 2005/0186013 A1 Aug. 25, 2005

(30) Foreign Application Priority Data

| | | |
|---|---|---|
| Dec. 16, 2003 | (JP) | P. 2003-418779 |
| Dec. 16, 2003 | (JP) | P. 2003-418780 |
| Dec. 16, 2003 | (JP) | P. 2003-418782 |
| Dec. 26, 2003 | (JP) | P. 2003-432454 |
| Jul. 15, 2004 | (JP) | P. 2004-209020 |
| Oct. 14, 2004 | (JP) | P. 2004-300245 |

(51) Int. Cl.
*A47L 1/08* (2006.01)
*B05C 1/00* (2006.01)
*B43K 27/08* (2006.01)

(52) U.S. Cl. ..... 401/23; 401/17; 401/34

(58) Field of Classification Search ..... 401/16–18, 401/21, 23, 34, 35
See application file for complete search history.

(56) References Cited

U.S. PATENT DOCUMENTS

| | | | | |
|---|---|---|---|---|
| 4,902,151 | A * | 2/1990 | Asano et al. | 401/34 |
| 5,338,123 | A * | 8/1994 | Obersteller et al. | 401/34 |
| 6,340,260 | B1 * | 1/2002 | Dao | 401/202 |
| 2001/0012468 | A1 | 8/2001 | Furukawa et al. | |

FOREIGN PATENT DOCUMENTS

| | | | |
|---|---|---|---|
| BE | 381 267 | A | 8/1931 |
| CN | 1270894 | A | 10/2000 |
| CN | 2666681 | Y | 12/2004 |
| DE | 2857370 | A1 | 6/1980 |
| DE | 298 09 659 | U1 | 10/1998 |
| EP | 1 151 873 | A1 | 11/2001 |
| JP | 05-212997 | A | 8/1993 |
| JP | D1095259 | A | 10/2000 |
| JP | 2001-334794 | A | 12/2001 |
| JP | 2002-36786 | A | 2/2002 |
| JP | 2002-036786 | A | 6/2002 |

OTHER PUBLICATIONS

European Search Report for EP 04 02 9696 dated Jul. 3, 2007.

* cited by examiner

*Primary Examiner*—David J. Walczak
(74) *Attorney, Agent, or Firm*—Sughrue Mion, PLLC

(57) ABSTRACT

A double-head writing instrument has a barrel having a partition formed inside thereof, first and second ink-tanks provided inside the barrel so as not to communicate each other, first and second ink-retaining members connected with first and second nibs provided on an opening of the first and second ink-tanks, respectively, first and second ink reserved inside first and second ink-reservoirs, respectively. The partition is extended in an axial direction so as that the first and second ink-reservoirs overlap each other in a radial direction, and thickness C of the partition and thickness D of a side wall of the barrel connected with the partition satisfy a relation of $0.2 \leqq C/D \leqq 2.5$.

8 Claims, 22 Drawing Sheets

DOUBLE-HEAD WRITING INSTRUMENT

BACKGROUND OF THE INVENTION

1. Field of the Invention

The present invention relates to a direct liquid feed type double-head writing instrument including each nib on both ends. In the present invention, "anterior or front" denotes a side of a first nib in a first ink tank and also the "anterior or front" denotes a second nib in a second ink tank, while "posterior or rear" denotes a side of the first ink reservoir in the first ink tank and also the "posterior or rear" denotes a side of the second ink reservoir in the second ink tank.

2. Description of the Related Art

This type double-head writing instrument discloses, for example, in Japanese Patent Unexamined Publication JP-A-2002-36786 as a writing instrument having a direct liquid feed-structured nib unit consisting of a nib, nib holder and ink tank detachably attached at both ends of a barrel. The JP-A-2002-36786 also discloses the double-head writing instrument having a nib, a cover plate, a clip and a color-specific band are colored in the same color as ink filled into an ink tank. At the same time, ink tanks, nib covers and caps are formed by transparent synthetic resins.

In the writing instrument of the JP-A-2002-36786, each of the ink in two ink housing parts is visually confirmed to be separated back and forth. In the writing instrument of the JP-A-2002-36786, particularly, in a case where a large amount of air exists in the ink housing part, when either nib is pointed downward, the distance between each of the ink in the ink housing parts becomes large, whereby this may lead to a reduction in aesthetic appeal. Further, where the writing instrument is contained and displayed in a pen stand or the like, ink color of the upper nib exposed out of the pen stand may be visually confirmed, however, ink color of the lower nib contained inside the pen stand cannot be visually confirmed. Accordingly, users may have inconvenience in this matter.

In addition, the writing instrument of the JP-A-2002-36786 is structured so that another member (color-indicating members) such as a clip or color-specific band of the same color with ink is attached to the cap in order to distinguish ink from the outside. Therefore, the writing instrument becomes larger in the number of parts and higher in production cost. Further, since the writing instrument of the JP-A-2002-36786 is structured so as for each cap to indicate the ink color, the cap must be attached only on the nib of the same color with the ink concerned. When the cap is attached by mistake on the opposite nib of a different color, a user may be confused in recognizing the color of the ink.

In addition, in the writing instrument of the JP-A-2002-36786, the bottom surface of the ink housing part in the ink tank is vertical to the axial direction. Thus, when the ink is filled into the ink housing part of the ink tank, the ink filling from a filling nozzle collides with the bottom surface of the ink housing part, and the ink may splatter outside. In particular, since in the case of a double-head writing instrument, a distance between the opening of the ink tank and the bottom surface is designed to be relatively short in the axial direction, ink is more likely to splatter out as described above.

Further, in the double-head writing instrument of the JP-A-2002-36786, no consideration is given to a relationship between a rear end of the guiding core projected from a rear end of the ink-retaining member and a ink level. Where the writing instrument is kept for a long time, with the nib pointed upward, the ink remaining inside the nib may drop back, or a capillary clearance inside the guiding core may clog due to dried ink. In this instance, there is the possibility of the occurrence of poor ink flow such as an inability to write or blurred writing at the nib which was kept pointed upward. In the conventional double-head writing instrument, in the case of a direct liquid type with nibs on the both sides having ink remaining members, when the writing instrument is stored in the upright position, either nib is inevitably pointed upward, and the above-mentioned nib pointed upward may often have an ink flow failure after a long-term storage of a nib pointed upward state. Further, in a double-head writing instrument, in the case of a direct liquid feed type with a nib on the one end having an ink remaining member, when the writing instrument is stored in the upright position for a long time, sufficient attention should be given so that the direct liquid feed nib is not pointed upward in order to avoid an ink flow failure.

Where the double-head writing instrument of the JP-A-2002-36786 with a small quantity of ink remaining in the ink reservoir is used for writing in a horizontal state or in a state where the nib is pointed diagonally upward, it may result in an insufficient contact between the guiding core and the ink inside the ink reservoir, there by causing an ink flow failure such as an inability to write or blurred writing.

Where a partition is extendedly provided in the axial direction, a mold core pin for forming the partition may be bent to the inner radial direction due to resin pressure during formation of the barrel thereby resulting in holes in the partition or occurrence of a sink on the outer surface of the side wall of the barrel or the inner surface of the barrel which is connected with the partition. In particular, a sink on an outer surface of the wall of the barrel may cause a printing failure when decorative printing is applied on the outer surface of the barrel.

SUMMARY OF THE INVENTION

The object of the present invention is to solve the above-described conventional problems.

In order to achieve the above mentioned object, according to a first aspect of the present invention, there is provided a double-head writing instrument, comprising:

a barrel formed by injection molding of transparent synthetic resin, the barrel opened at first and second ends thereof, the barrel having a partition formed therein;

first and second ink-tanks provided inside the barrel and defined by the barrel and the partition so as not to communicate each other, the first and second ink-tanks opened at the first and second ends of the barrel, respectively;

a first ink-retaining member connected with a first nib provided on an opening of the first ink-tank;

a first ink reserved inside a first ink-reservoir which is provided inside the first ink-tank and at rear of the first ink-retaining member;

a second ink-retaining member connected with a second nib provided on an opening of the second ink-tank; and a second ink reserved inside a second ink-reservoir which is provided inside the second ink-tank and at rear of the second ink-retaining member, wherein the first and second ink-retaining members retain temporarily the first and second ink spilled in accordance with an increase in pressure inside the first and second ink-reservoirs, respectively, the partition is extended in an axial direction of the writing instrument so as that the first and second ink-reservoirs overlap each other in a radial direction, and thickness C of the partition and thickness D of a side wall of the barrel connected with the partition satisfy a relation of $0.2 \leqq C/D \leqq 2.5$.

In the double-head writing instrument 1 according to the first aspect of the present invention, the partition 3 is extended in the axial direction, the first ink reservoir 7A and the second ink reservoir 7B are constructed by the partition 3 so as to overlap each other in the radial direction, thereby the first ink 8A inside the first ink reservoir 7A and the second ink 8B inside the second ink reservoir 7B can be visually closely confirmed from the outside thereby increasing aesthetic appeal. In addition, where the double-head writing instrument of the present invention is contained or displayed in a pen stand and the like in an upright position, the first ink reservoir 7A exposed above the pen stand and the second ink reservoir 7B can be visually confirmed at the same time, and the color of the first ink 8A inside the first ink reservoir 7A and the color of the second ink 8B inside the second ink reservoir 7B can also be easily confirmed. Further, in the double-head writing instrument 1 according to the first aspect of the present invention, the partition 3 is formed integrally inside the barrel 2 opened at both ends and the first ink tank 5A and the second ink tank 5B are formed directly on the barrel 2, thereby reducing the number of parts and also keeping the production cost to a lower level.

Further, for the double-head writing instrument 1 according to the first aspect of the present invention, where the ratio of thickness C of the partition 3 to thickness Dl of the side wall of the barrel 2 connected with the partition 3, or (C/D) satisfies the relationship $0.2 \leqq C/D \leqq 2.5$ (preferably $0.3 \leqq C/D \leqq 1.5$), thereby preventing a mold core pin forming the partition 3 from bending to the inner radial direction due to resin pressure during formation of the barrel hole of the partition 3 as well as preventing a sink from occurring on the outer surface of the side wall of the barrel, the inner surface of which is connected with the partition 3. The thickness D of the side wall of the barrel 2 connected with the partition 3 refers to the thickness of the side wall of the barrel 2 other than the part connected with the partition 3 at a region of the partition 3 extended in the axial direction.

Where the C/D is smaller than 0.2 (namely, $C/D<0.2$), the thickness C of the partition 3 is made excessively smaller in comparison with the thickness D of the side wall of the barrel 2 connected with the partition 3 and the partition 3 may be holed during molding due to an insufficient fill of resin. In contrast, where the C/D is greater than 2.5 (namely, $C/D>2.5$), the thickness C of the partition 3 is made excessively thick in comparison with the thickness D of the side wall of the barrel 2 connected with the partition 3 and a sink may occur on the outer surface of the side wall of the barrel 2 connected with the partition 3.

According to a second aspect of the present invention as set forth in the first aspect of the present invention, it is preferable that a printed layer is provided on an outer surface of the side wall of the barrel connected with the partition.

In combination with the structure according to the first aspect of the present invention in which sink occurrence on the outer face of the side wall of the barrel 2 connected with the partition 3 can be suppressed, the double-head writing instrument 1 according to the second aspect of the present invention can be assuredly provided with the printed layer 21 which is appropriate and free from printing failure on the outer surface of the side wall of the barrel 2 connected with the partition 3.

According to a third aspect of the present invention as set forth in the first aspect of the present invention, it is preferable that the first ink is different in color from the second ink.

The double-head writing instrument 1 according to the third aspect of the present invention is constructed so as to allow the first ink reservoir 7A and the second ink reservoir 7B to overlap each other in a radial direction through the partition 3 and also reserve different color inks in the first ink reservoir 7A and the second ink reservoir 7B, thereby the inks of two different colors in the ink reservoirs can be visually closely confirmed and aesthetic appeal is also increased. Further, when the double-head writing instrument 1 according to the third aspect of the present invention is contained or displayed in a pen stand and the like, the first ink reservoir 7A exposed above the pen stand and the second ink reservoir 7B also can be easily confirmed at the same time and the combination of two colors (namely, combination of colors consisting of the two different colors) can be easily confirmed. Further, the combination of different colors includes colored inks different in color and inks of a colored ink and a colorless ink (colorless liquid).

According to a fourth aspect of the present invention as set forth in the third aspect of the present invention, it is preferable that the double-head writing instrument further comprises:

first and second caps detachably attached on the barrel at the first and second nib side, respectively, the first and second caps made of transparent or translucent material, wherein the first and second nibs are colored in the same color with the first and second ink, and the first and second nibs are constructed so as to be visually confirmed from the outside when the first and second cap are attached on both ends of the barrel.

Since the double-head writing instrument 1 according to the fourth aspect of the present invention does not need to have color indicating members on the first cap 9A and the second cap 9B, the structure can be simplified and available at a lower price due to a reduction in production costs. Further, where the writing instrument is constructed so that the first ink reservoir 7A and the second ink reservoir 7B overlap through the partition 3 in the axial direction as described in the first aspect of the present invention, it is difficult to identify the ink color of the nib at one glance over the ink reservoir. However, in the writing instrument according to the fourth aspect of the present invention wherein the first cap 9A and the second cap 9B are made of transparent or translucent material, the first nib 4A and the second nib 4B can be easily confirmed for the ink color in a state where the first cap 9A and the second cap 9B are attached. In addition, coloring the nib in the same color of the ink includes, for example, a composition that ink is allowed to permeate into the nib or attach on the outer surface of the nib, that in which the outer surface of the nib is colored in the same color with the ink, or that in which a nib holder holding the outer surface of the nib is colored in the same color with the ink so that the ink color can be recognized externally.

According to a fifth aspect of the present invention as set forth in the fourth aspect of the present invention, it is preferable that at least one of the first and second caps are capable of attaching on both of the first nib or the second nib.

The double-head writing instrument 1 according to the fifth aspect of the present invention is constructed so that the first cap 9A and the second cap 9B can be attached on either the first nib 4A or the second nib 4B (to be specific, the configuration of a joint part on the first cap 9A is identical to that on the second cap 9B and the configuration of the joint part on the first ink tank 5A is identical to that on the second ink tank 5B), thereby users are not confused in recognizing the ink color and can identify the ink color even when either the first cap 9A or the second cap 9B is attached on the nib, making it unnecessary for a user to distinguish the first cap 9A and the second cap 9B to attach them on the nibs, respectively.

According to a sixth aspect of the present invention as set forth in the third aspect of the present invention, it is preferable that when the first nib or the second nib is pointed downward, both of the first and second ink are visually confirmed from left and right side.

Where the first nib 4A or the second nib 4B is pointed downward (namely, either the first nib 4A or the second nib 4B is pointed downward, while the other side is pointed upward), two different color inks tend to separate above and below. However, in the case of the double-head writing instrument 1 according to the sixth aspect of the present invention, since a sufficient quantity of ink is filled, even when the first nib 4A or the second nib 4B is pointed downward, the two different color inks can be visually confirmed from side to side through the partition 3 (namely, in a radial direction) and more assuredly observed for a state where the two different color inks overlap each other closely. As a result, when purchased by a user, the writing instrument contained or displayed in a pen stand and the like, the first ink reservoir 7A and the second ink reservoir 7B can be visually confirmed at the same time to maintain aesthetic appeal, and the combination of two different colors can be more easily confirmed.

According to a seventh aspect of the present invention as set forth in the first aspect of the present invention, it is preferable that inclined surfaces slanting relative to the axial direction are provided on an inner surface of the partition on the first ink-reservoir side and second ink-reservoir sides, respectively.

The double-head writing instrument 1 according to the seventh aspect of the present invention has inclined planes 321, 331 and 341 slanting toward the axial direction (namely, surfaces not vertical to the axial direction) on the inner surface of the partition 3, thereby, when filling the ink, the ink is prevented from being splattered from the opening of the first ink tank 5A or that of the second ink tank 5B, when the ink collides with the partition 3.

According to an eighth aspect of the present invention as set forth in the seventh aspect of the present invention, it is preferable that one end of the partition is connected with the side wall of the barrel in a vicinity of the first ink-retaining member and the other end of the partition is connected with the sidewall of the barrel in a vicinity of the second ink-retaining member.

In the above writing instrument, the axial length of the first ink tank 5A and that of the second ink tank 5B can be set relatively longer, thereby preventing the ink from being splattered during filling.

According to a ninth aspect of the present invention as set forth in the seventh aspect of the present invention, it is preferable that the partition comprises:

a central wall extending in the axial direction; and bottom walls connected with both ends of the central wall and also with the side wall of the barrel, the bottom wall slanting relative to the axial direction.

Whereby the axial length of the first ink tank 5A and that of the second ink tank 5B can be set relatively longer, and the ink can be prevented from being splattered during filling.

According to a tenth aspect of the present invention as set forth in the seventh aspect of the present invention, it is preferable that the inclined plane is visually confirmed almost over entire partitions, when the partition is viewed from the opening of the first ink-tank and also when viewed from the opening of the second ink-tank.

Whereby the partition 3 is free from any surface vertical to the axial direction, which makes it more effective to prevent the ink from being splattered during filling.

According to an eleventh aspect of the present invention as set forth in the first aspect of the present invention, it is preferable that the double-head writing instrument further comprising a first and second caps detachably attached to an outer surface of the barrel on the first and second nib side, respectively, wherein the first ink-tank comprises:

a first large-diameter part opened forward; and a first small-diameter part which is constituted in small by the partition and continuously formed at rear of the first large-diameter part, wherein the second ink-tank comprises:

a second large-diameter part opened forward; and a second small-diameter part which is constituted in small by the partition and continuously formed at rear of the second large-diameter part, wherein the first ink-retaining member is provided inside the first large-diameter part, the second ink-retaining member is provided inside the second large-diameter part, the first and second ink-reservoirs directly reserve the first and second ink, the first and second inks are visually confirmed, a first engagement portion of the barrel which engages with the first cap is provided anterior to the first small-diameter part, and a second engagement portion of the barrel which engages with the second cap is provided anterior to the second small-diameter part.

In the double-head writing instrument 1 according to the eleventh aspect of the present invention, the first ink 7A in the first small-diameter part 52A and the second ink 7B in the second small-diameter part 52B can be visually closely confirmed from the outside, thereby increasing aesthetic appeal. In addition, in the double-head writing instrument 10 according to the eleventh aspect of the present invention, when contained or displayed in a pen stand and the like, the first small-diameter part 52A exposed above the pen stand and the like and the second small-diameter part 52B can be visually confirmed at the same time, and the color of the first ink 7A and that of the second ink 7B can also be easily confirmed.

Further, in the double-head writing instrument 1 according to the eleventh aspect of the present invention, a sink may easily occur on the outer surface of the barrel 2 having therein the partition 3 extended in a longitudinal axis. Therefore, where a joint part with the cap is provided on the outer surface of the barrel 2 having the partition 3, the part may not be properly formed due to a sink, of ten resulting in a joint failure of the cap. However, in the double-head writing instrument 1 of the eleventh aspect of the present invention, the joint part with the cap is provided on the barrel 2 anterior to the first small-diameter part 52A and the barrel 2 anterior to the second small-diameter part 52B, the proper joint with a cap can be obtained even when a sink occurs on the outer surface of the barrel 2 having therein the partition 3.

According to a twelfth aspect of the present invention as set forth in the eleventh aspect of the present invention, it is preferable that when the first cap is attached to the outer surface of the barrel on the first nib side, a rear end of the first cap is positioned anterior to the first small-diameter part, and when the second cap is attached to the outer surface of the barrel on the second nib side, a rear end of the second cap is positioned anterior to the second small-diameter part.

The double-head writing instrument 1 according to the twelfth aspect of the present invention is, as described previously, constructed so that the first small-diameter part 52A is not overlapped by the first cap 9A even when the first cap 9A is attached on the first nib 4A, and the outer surface of the small-diameter part 52B is not overlapped by the second cap 9B even when the second cap 9B is attached to the second nib 4B. Therefore, the first ink 7A and the second 7B can be easily confirmed from the outside and aesthetic appeal can be further obtained.

According to a thirteenth aspect of the present invention as set forth in the eleventh aspect of the present invention, it is preferable that the first and second engagement portions include an overridden engagement part and an air-tight sealed part, wherein the overridden engagement part is provided on the outer surface of the first and second large-diameter part, respectively, and the air-tight sealed part is provided on a front end of the first and second large-diameter part, respectively.

The double-head writing instrument 1 according to the thirteenth aspect of the present invention is constructed, in combination with the composition described in the eleventh aspect of the present invention, wherein a sink occurrence on the overridden engagement parts 511A and 511B or air-tight sealed parts 512A and 512B can be prevented, thereby providing a more appropriate joint structure with the cap. Further, the air-tight sealed parts, 512A and 512B, are provided on the front end of the first large-diameter part 51A and the front end of the second large-diameter part 51B, thereby reducing least possible degree air compressed inside the cap when attaching the cap.

According to a fourteenth aspect of the present invention as set forth in the first aspect of the present invention, it is preferable that a first guiding core supplying the first ink from the first ink-reservoir to the first nib is inserted at an axial center of the first ink-retaining member, a rear end of the first guiding core projects posterior to a rear end of the first ink-retaining member so as to contact with the first ink when the first nib is pointed upward, a second guiding core supplying the second ink from the second ink-reservoir to the second nib is inserted at an axial center of the second ink-retaining member, and a rear end of the second guiding core projects posterior to a rear end of the second ink-retaining member so as to contact with the second ink when the second nib is pointed upward.

Where the double-head writing instrument 1 according to the fourteenth aspect of the present invention is stored for a long time, with the first nib 4A pointed upward, the rear end of the first guiding core 61A is in contact with the first ink 8A (namely, the rear end of the first guiding core 61A is positioned lower than the level of the first ink 8A), thereby avoiding possible drop-back inside the first nib 4A or clogging due to drying, thereby preventing an ink flow failure at the first nib 4A. Similarly, where the double-head writing instrument 1 according to the first aspect of the present invention is stored for a long time, with the second nib 4B pointed upward, the rear end of the second guiding core 61B is in contact with the second ink 8B (namely, the rear end of the second guiding core 61B is positioned lower than the level of the second ink 8B), thereby avoiding possible drop-back inside the second nib 4B or clogging due to drying, thereby preventing an ink flow failure at the second nib 4B.

Further, the first nib 4A and the second nib 4B may include, for example, fiber modifications, porous material, brush bodies, extrusion moldings of synthetic resins, ball-point pen tips and metal tips of fountain pens and the like. The first guiding core 61A and the second guiding core 61B may include, for example, extrusion moldings of synthetic resins and resinated fiber products. In addition, the first guiding core 61A and the second guiding core 61B may be constructed to function as a nib as well.

According to a fifteenth aspect of the present invention as set forth in the fourteenth aspect of the present invention, it is preferable that one end of the partition is connected with the side wall of the barrel in a vicinity of the first ink-retaining member and the other end of the partition is connected with the side wall of the barrel in a vicinity of the second ink-retaining member.

In the double-head writing instrument 1 according to the fifteenth aspect of the present invention, when the first nib 4A is used, with the nib kept horizontally, under the condition where the first ink 8A in the first ink reservoir 7A remains in a smaller quantity, one end of the partition 3 and a part connected with the side wall of the barrel 2 in the vicinity of the first ink-retaining member 6A are pointed downward, the first ink remaining in a small quantity in the first ink reservoir 7A is moved to the rear end of the first ink-retaining member 6A, and a condition where the rear end of the first guiding core 61A is in contact with the first ink 8A can be maintained, thereby preventing an ink flow failure from occurring (refer to FIG. 20). Similarly, in the double-head writing instrument 1 according to the fifteenth aspect of the present invention, when the second nib 4B is used, with the nib kept horizontal, under the condition where the second ink 8B in the second ink reservoir 7B remains in a smaller quantity, one end of the partition 3 and apart connected with the side wall of the barrel 2 in the vicinity of the second ink-retaining member 6B are pointed downward, allowing the second ink remaining in a small quantity in the second ink reservoir 7B to move to the rear end of the second ink-retaining member 6B, thereby maintaining a condition where the rear end of the second guiding core 61B is in contact with the second ink 8B and preventing an ink flow failure occurrence.

According to a sixteenth aspect of the present invention as set forth in the fifteenth aspect of the present invention, it is preferable that the partition comprises:

a central wall extending in the axial direction;

a first bottom wall connecting one end of the central wall and the side wall of the barrel in a vicinity of the first ink-retaining member; and a second bottom wall connecting the other end of the central wall and the side wall of the barrel in a vicinity of the second ink-retaining member, wherein the first bottom wall and a rear end surface of the first ink-retaining member forms a first concave space, the rear end of the first guiding core is positioned inside the first concave space, the second bottom wall and a rear end surface of the second ink-retaining member forms a second concave space, and the rear end of the second guiding core is positioned inside the second concave space.

In the double-head writing instrument 1 according to the sixteenth aspect of the present invention, when the first nib 4A is used, with the nib kept obliquely upward, under the condition that the first ink 8A in the first ink reservoir 7A remains in a smaller quantity, the first concave space 71A is positioned lower, allowing the first ink remaining in a small quantity in the first ink reservoir 7A to be retained at the first concave space 71A, keeping the rear end of the first guiding core 61A in contact with the first ink 8A, thereby preventing possible ink flow failure. Similarly, in the double-head writing instrument 1 of the sixteenth aspect of the present invention, when the second nib 4B is used, with the nib kept obliquely upward, under the condition that the second ink 8B in the second ink reservoir 7B remains in a smaller quantity, the second concave space 71B is positioned lower, allowing the second ink remaining in a small quantity in the second ink reservoir 7B to be retained at the second concave space 71B, keeping the rear end of the second guiding core 61B in contact with the second ink 8B, thereby preventing possible ink flow failure.

According to a seventeenth aspect of the present invention as set forth in the sixteenth aspect of the present invention, it is preferable that a first rib extending in the axial direction is provided on the inner surface of the side wall of the barrel constituting the first concave space or on the first bottom wall, a first clearance having capillary force is formed between the first rib and the outer circumferential surface of the rear end of the first guiding core, a second rib extending in the axial direction is formed on the inner surface of the side wall of the barrel constituting the second concave space or on the second bottom wall, and a second clearance having capillary force is formed between the second rib and the outer circumferential surface of the rear end of the second guiding core.

In the double-head writing instrument 1 according to the seventeenth aspect of the present invention, even when the first ink 8A in the first ink reservoir 7A remains in a further smaller quantity, the first ink 8A can be supplied to the rear end of the first guiding core 61A through the clearance 73A having capillary force, the clearance 73A formed between the first rib 72A and the outer circumferential surface of the rear end of the first guiding core 61A, thereby making it possible to use the first ink 8A in the first ink reservoir 7A to the last, without having ink flow failure. Similarly, in the double-head writing instrument 1 according to the seventeenth aspect of the present invention, even when the second ink 8B in the second ink reservoir 7B remains in a further smaller quantity, the second ink 8B can be supplied to the rear end of the second guiding core 61B through the clearance 73B having capillary force formed between the second rib 72B and the outer circumferential surface of the rear end of the second guiding core 61B, thereby making it possible to use the second ink 8B in the second ink reservoir 7B to the last, without having ink flow failure.

According to an eighteenth aspect of the present invention as set forth in the first aspect of the present invention, it is preferable that a capacity of the first ink-reservoir is equal to that of the second ink-reservoir.

According to a nineteenth aspect of the present invention as set forth in the first aspect of the present invention, it is preferable that a capacity of the first ink-reservoir is different from that of the second ink-reservoir.

According to a twentieth aspect of the present invention as set forth in the nineteenth aspect of the present invention, it is preferable that a distance defined between a connected end on the first nib of the partition and the rear end of the first ink-retaining member is different from a distance defined between a connected end on the second nib of the partition and the rear end of the second ink-retaining member.

According to a twenty-first aspect of the present invention as set forth in the nineteenth aspect of the present invention, it is preferable that size of the bottom wall of the first ink-reservoir is different from that of the bottom wall of the second ink-reservoir.

According to a twenty-second aspect of the present invention, there is provided a barrel of the double-head writing instrument, comprising:

a barrel main body opened at first and second ends and formed by injection molding of synthetic resin, the barrel main body having a partition integrally formed therein to define first and second ink-tanks therein, wherein the first and second ink-tanks are opened at first and second ends of the barrel main body, respectively, and constructed so as not to communicate with each other, the partition is extended in an axial direction of the writing instrument so that the first ink-tank and the second ink-tank overlap each other in a radial direction of the writing instrument, and thickness C of the partition and thickness D of a side wall of the barrel main body which connects with the partition satisfy relation of $0.2 \leqq C/D \leqq 2.5$.

According to a twenty-third aspect of the present invention as set forth in the twenty-second aspect of the present invention, it is preferable that a printed layer is provided on an outer surface of the side wall of the barrel main body connected with the partition.

According to a twenty-fourth aspect of the present invention, there is provided a double-head writing instrument, comprising:

a barrel made of transparent or translucent material, and opened at first and second ends thereof, the barrel having a partition integrally formed therein;

first and second ink-tanks provided inside the barrel, defined by the barrel and the partition so as not to communicate each other, and opened at the first and second ends of the barrel, respectively;

a first ink-retaining member connected with a first nib provided on an opening of the first ink-tank;

a first ink reserved inside a first ink-reservoir which is provided inside the first ink-tank at rear of the first ink-retaining member;

a second ink-retaining member connected with a second nib provided on an opening of the second ink-tank; and a second ink reserved inside a second ink-reservoir which is provided inside the second ink-tank at rear of the second ink-retaining member, wherein the first and second ink-retaining members retain temporarily the first and second ink spilled in accordance with an increase in pressure inside the first and second ink-reservoirs, respectively, the first and second ink-reservoirs are provided so as to overlap each other in a radial direction of the writing instrument, and the first ink is different in color from the second ink.

According to a twenty-fifth aspect of the present invention asset for thin the twenty-fourth aspect of the present invention, it is preferable that the first and second caps are detachably attached to the barrel on first and second nib sides, the first and second caps are made of transparent or translucent material, the first nib is colored in the same color with the first ink, the second nib is colored in the same color with the second ink, and the first nib and the second nib are visually confirmed from outside when the first and second caps are attached to first and second ends of the barrel.

According to a twenty-sixth aspect of the present invention as set forth in the twenty-fifth aspect of the present invention, it is preferable that at least one of the first and second caps are capable of attaching to either of the first nib or the second nib.

According to a twenty-seventh aspect of the present invention as set forth in the twenty-fourth aspect of the present invention, it is preferable that when the first nib or the second nib is pointed downward, the first and second ink are visually confirmed from left and right side.

According to a twenty-eighth aspect of the present invention there is provided a double-head writing instrument, comprising:

a barrel opened at first and second ends thereof, the barrel having a partition integrally formed therein;

first and second ink-tanks provided inside the barrel, defined by the barrel and the partition so as not to communicate each other, and opened at the first and second ends of the barrel;

a first ink-retaining member connected with a first nib provided on an opening of the first ink-tank;

a first ink reserved inside a first ink-reservoir which is provided inside the first ink-tank at rear of the first ink-retaining member;

a second ink-retaining member connected with a second nib provided on an opening of the second ink-tank; and a second ink reserved inside a second ink-reservoir which is provided inside the second ink-tank at rear of the second ink-retaining member, wherein the first and second ink-retaining members retain temporarily the first and second ink spilled in accordance with an increase in pressure inside the first and second ink-reservoirs, respectively, inclined surfaces slanting relative to an axial direction of the writing instrument are provided on an inner surface of the partition on the first ink-reservoir side and second ink-reservoir side, respectively.

According to a twenty-ninth aspect of the present invention as set forth in the twenty-eighth aspect of the present invention, it is preferable that one end of the partition is connected with a side wall of the barrel in a vicinity of the first ink-retaining member, and the other end of the partition is connected with the sidewall of the barrel in a vicinity of the second ink-retaining member.

According to a thirtieth aspect of the present invention as set forth in the twenty-eighth aspect of the present invention, it is preferable that the partition comprises:

a central wall extending in the axial direction and a bottom wall connected with both ends of the central wall and also with the side wall of the barrel and slanting toward the axial direction.

According to a thirty-first aspect of the present invention as set forth in the twenty-eighth aspect of the present invention, it is preferable that the inclined plane is visually confirmed almost over entire partitions, when the partition is viewed from the opening of the first ink-tank and also when viewed from the opening of the second ink-tank.

According to a thirty-second aspect of the present invention, there is provided a double-head writing instrument, comprising:

a main body made of transparent or translucent synthetic resin including a barrel having first and second ends, and first and second nibs provided at the first and second ends of the barrel; and first and second caps detachably attached to an outer surface of the main body on the first and second nib sides, respectively, wherein a partition is integrally formed inside the barrel to define first and second ink-tanks in the barrel together with the barrel, and continuously provided along with an axial direction of the writing instrument, the first and second ink-tanks are opened at the first and second ends of the barrel, respectively, and structured so as not to communicate each other, the first ink-tank includes a first large-diameter part opened forward and a first small-diameter part which is constituted in small by the partition and continuously formed at rear of the first large-diameter part, a first ink-retaining member is provided inside the first large-diameter part, a first ink-reservoir which directly reserves a first ink is provided in the first ink-tank at rear of the first ink-retaining member, the second ink-tank includes a second large-diameter part opened forward and a second small-diameter part which is constituted in small by the partition and continuously formed rear of the second large-diameter part, a second ink-retaining member is provided inside the second large-diameter part, a second ink-reservoir which directly reserves a second ink is provided in the second ink-tank at rear of the second ink-retaining member, the first and second ink-tanks are provided so as that the first and second ink are visually confirmed, a first engagement portion of the barrel which engages with the first cap is provided anterior to the first small-diameter part, and a second engagement portion of the barrel which engages with the second cap is provided anterior to the second small-diameter part.

According to a thirty-third aspect of the present invention as set forth in the thirty-second aspect of the present invention, it is preferable that when the first cap is attached to the outer surface of the barrel on the first nib side, a rear end of the first cap is positioned anterior to the first small-diameter part, and when the second cap is attached to the outer surface of the barrel on the second nib side, a rear end of the second cap is positioned anterior to the second small-diameter part.

According to a thirty-fourth aspect of the present invention as set forth in the thirty-second aspect of the present invention, it is preferable that the first and second engagement portions comprise an overridden engagement part and an air-tight sealed part, respectively, the overridden engagement part is provided on the outer surface of the first and second large-diameter part, respectively, and the air-tight sealed part is provided on a front end of the first and second large-diameter part, respectively.

According to a thirty-fifth aspect of the present invention, there is provided a double-head writing instrument, comprising:

a barrel having first and second openings and a partition formed therein so as to form first and second ink-tanks therein;

a first nib provided on a first opening of first ink-tank; and a second nib provided on a second opening of second ink-tank, wherein the first and second ink-tanks are opened to the first and second opening of the barrel, respectively, and are structured so as not to communicate each other, an ink-retaining member which connects with the first or second nib is provided at rear of the first or second nib on at least one of the first ink-tank and the second ink-tank, an ink-reservoir which directly reserves an ink is provided at rear of the ink-retaining member, the ink-retaining member retains temporarily the ink spilled in accordance with an increase in pressure inside the ink-reservoir, a guiding core supplying the ink from the ink-reservoir to the first or second nib is inserted at an axial center of the ink-retaining member, and a rear end of the guiding core projects posterior to a rear end of the ink-retaining member so as to contact with the ink when the first or second nib is pointed upward.

According to a thirty-sixth aspect of the present invention, there is provided a double-head writing instrument, comprising:

a barrel having a first opening, a second opening and a partition formed therein so as to define first and second ink-tanks therein;

a first nib provided on a first opening of the first ink-tank;

a first ink-retaining member provided in the first opening of the first ink-tank at rear of the first nib, the first ink-retaining member connecting with the first nib;

a first ink-reservoir which reserves directly a first ink, the first ink-reservoir provided in the first ink-tank at rear of the first ink-retaining member;

a first guiding core supplying the first ink from the first ink-reservoir to the first nib, and inserted at an axial center of the first ink-retaining member, a rear end of the first guiding core projecting posterior to a rear end of the first ink-retaining member so as to contact with the first ink when the first nib is pointed upward;

a second nib provided on a second opening of the second ink-tank;

a second ink-retaining member provided in the second opening of the second ink-tank at rear of the second nib, the second ink-retaining member connecting with the second nib;

a second ink-reservoir which reserves directly a second ink, the second ink-reservoir provided in the second ink-tank at rear of the second ink-retaining member; and a second guiding core supplying the second ink from the second ink-reservoir to the second nib, and inserted at an axial center of the second ink-retaining member, a rear end of the second guiding core projects posterior to a rear end of the second ink-retaining member so as to contact with the second ink when the second nib is pointed upward, wherein the first and second ink-tanks opens to the first and second opening of the barrel, respectively, and are structured so as not to communicate each other, and the first and second ink-retaining members retaining temporarily the first and second ink spilled in accordance with an increase in pressure inside the first and second ink-reservoir, respectively.

According to a thirty-seventh aspect of the present invention as set forth in the thirty-sixth aspect of the present invention, it is preferable that the partition is extended in an axial direction of the writing instrument, one end of the partition is connected with a sidewall of the barrel in a vicinity of the first ink-retaining member, and the other end of the partition is connected with the side wall of the barrel in a vicinity of the second ink-retaining member.

According to a thirty-eighth aspect of the present invention as set forth in the thirty-seventh aspect of the present invention, it is preferable that the partition comprises:

a central wall extending in the axial direction;

a first bottom wall connecting one end of the central wall and the side wall of the barrel in a vicinity of the first ink-retaining member; and a second bottom wall connecting the other end of the central wall and the side wall of the barrel in a vicinity of the second ink-retaining member, wherein the first bottom wall and a rear end surface of the first ink-retaining member forms a first concave space, the rear end of the first guiding core is positioned inside the first concave space, the second bottom wall and a rear end surface of the second ink-retaining member forms a second concave space, and the rear end of the second guiding core is positioned inside the second concave space.

According to a thirty-ninth aspect of the present invention as set forth in the thirty-eighth aspect of the present invention, it is preferable that a first rib extending in the axial direction is provided on the inner surface of the side wall of the barrel constituting the first concave space or on the first bottom wall, a first clearance having capillary force is formed between the first rib and the outer circumferential surface of the rear end of the first guiding core, a second rib extending in the axial direction is formed on the inner surface of the side wall of the barrel constituting the second concave space or on the second bottom wall, and a second clearance having capillary force is formed between the second rib and the outer circumferential surface of the rear end of the second guiding core.

According to a fortieth aspect of the present invention, there is provided a double-head writing instrument, comprising:

a barrel formed by injection molding of transparent synthetic resin, the barrel opened at first and second ends thereof, the barrel having a partition formed therein;

first and second ink-tanks provided inside the barrel and defined by the barrel and the partition so as not to communicate each other, the first and second ink-tanks opened at the first and second ends of the barrel, respectively;

a first ink-retaining member connected with a first nib provided on an opening of the first ink-tank;

a first ink reserved inside a first ink-reservoir which is provided inside the first ink-tank and at rear of the first ink-retaining member;

a second ink-retaining member connected with a second nib provided on an opening of the second ink-tank; and a second ink reserved inside a second ink-reservoir which is provided inside the second ink-tank and at rear of the second ink-retaining member, wherein the first and second ink-retaining members retain temporarily the first and second ink spilled in accordance with an increase in pressure inside the first and second ink-reservoirs, respectively, and the partition is extended in an axial direction of the writing instrument so as that the first and second ink-reservoirs overlap each other in a radial direction.

Effects of the Invention

The double-head writing instrument according to the first aspect of the present invention is provided with an increased aesthetic appeal. Also, the double-head writing instrument is visually easily recognized for the ink color of the first ink reservoir and that of the second ink reservoir when contained or displayed in a pen stand and the like. Further, it is possible to become lower in the number of parts to thereby reduce the production cost. Furthermore, it is not occurred that any holes formed on the partition or sink formed on the outer surface of the side wall of the barrel which connected with the partition.

The double-head writing instrument according to the second aspect of the present invention can assuredly be provided with an appropriate printed layer free from printing failure on the outer surface of the side wall of the barrel connected with the partition.

The double-head writing instrument according to the third aspect of the present invention can be visually confirmed for two different color inks in the ink reservoirs closely with an increased aesthetic appeal. Further, the double-head writing instrument can be visually confirmed at the same time for the first ink reservoir and the second ink reservoir when the double-head writing instrument is contained or displayed in a pen stand and the like and visually easily recognized for combination of two different colors.

The double-head writing instrument according to the fourth aspect of the present invention is simple in structure for identifying the ink color to thereby lower in production costs. Further, the double-head writing instrument can visually recognize the ink color of the nib, with the cap attached thereon, in addition to the effects described in the third aspect of the present invention.

In the double-head writing instrument according to the fifth aspect of the present invention, the ink color can be easily identified when the first cap or the second cap is attached on either nib. Users are not required to attach the caps on the nibs by distinguishing the first cap from the second cap, in addition to the effects described in the fourth aspect of the present invention.

In the double-head writing instrument according to the sixth aspect of the present invention, aesthetic appeal can be maintained, when the double-head writing instrument contained or displayed in a pen stand and the like, and combination of two different colors can be more easily visually recognized.

The double-head writing instrument according to the seventh aspect of the present invention can prevent ink from being splattered during filling the ink.

The double-head writing instrument according to the eighth aspect of the present invention can more effectively prevent ink from being splattered during filling the ink.

The double-head writing instrument according to the ninth aspect of the present invention can more effectively prevent ink from being splattered during filling the ink.

The double-head writing instrument according to the tenth aspect of the present invention can more effectively prevent ink from being splattered during filling the ink.

In the double-head writing instrument according to the eleventh aspect of the present invention, aesthetic appeal is increased. Further, color of the first ink and that of the second ink can be more easily visually recognized even when contained or displayed in a pen stand and the like. Furthermore, an appropriate fitting structure can be obtained even when a sink occurs on the outer surface of the barrel having the partition therein.

In the double-head writing instrument according to the twelfth aspect of the present invention, the first ink and the second ink can be more visually easily recognized from the outside, and aesthetic appeal can be further improved.

In the double-head writing instrument according to the thirteen aspect of the present invention, an appropriate fitting structure can be obtained and air compressed inside the cap when attaching the cap can be reduced to the lowest possible amount.

In the double-head writing instrument according to the fourteenth aspect of the present invention, ink flow failure will not take place, with either the first nib or the second nib kept upward for a long time.

In the double-head writing instrument according to the fifteenth aspect of the present invention, when used, with the nib kept horizontally, under the condition that the ink in the first or the second ink reservoir remains in a small quantity, the ink in the first or the second ink reservoir is kept in the vicinity of the rear end of the first or the second ink-retaining member, the rear end of the first or second guiding core is kept in contact with the ink, thereby preventing possible ink flow failure.

In the double-head writing instrument according to the sixteenth aspect of the present invention, when used, with the nib kept obliquely upward, under the condition that the ink in the first or the second ink reservoir remains in a small quantity, the ink in the first or the second ink reservoir is kept at the concave space in the vicinity of the rear end of the first or the second ink-retaining member, the rear end of the first or second guiding core is kept in contact with the ink, thereby preventing possible ink flow failure.

In the double-head writing instrument according to the seventh aspect of the present invention, even when the ink either in the first or the second ink reservoir remains in a further smaller quantity, the ink can be sufficiently supplied to the rear end of the guiding core and writing can be continued until the ink in the first or second ink reservoir is used up.

DETAILED DESCRIPTION OF THE PREFERRED EMBODIMENTS

Figure 1:
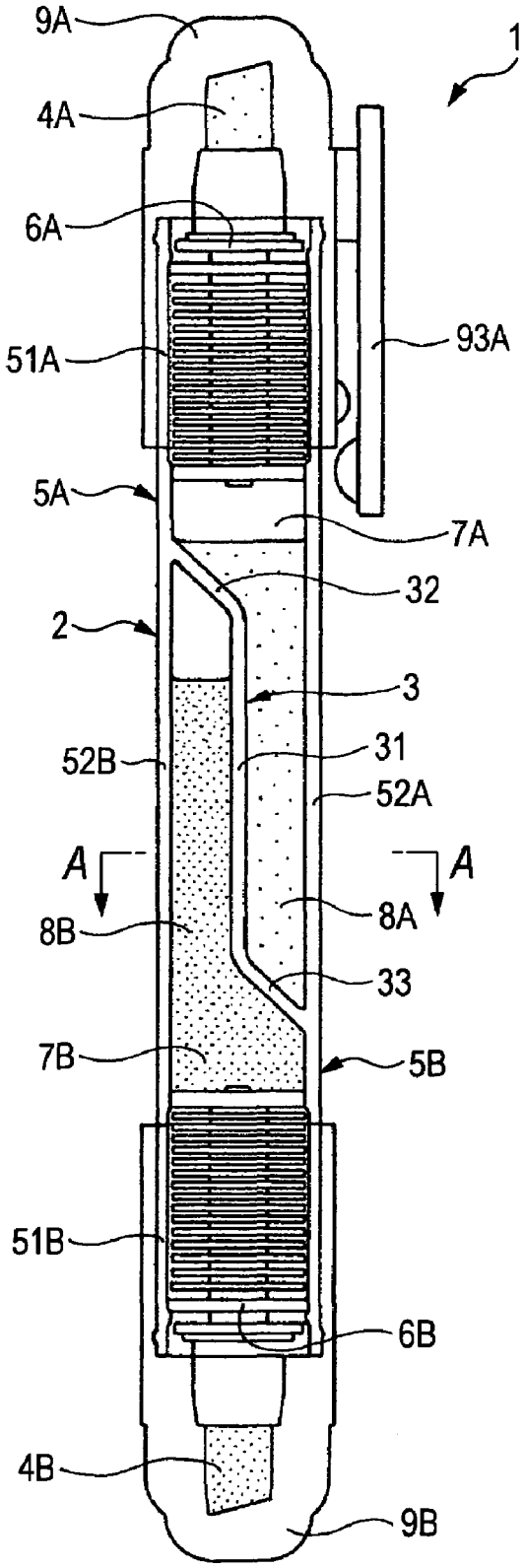
FIG. 1 is an external view showing a double-head writing instrument of the first embodiment according to the present invention.
Figure 2:
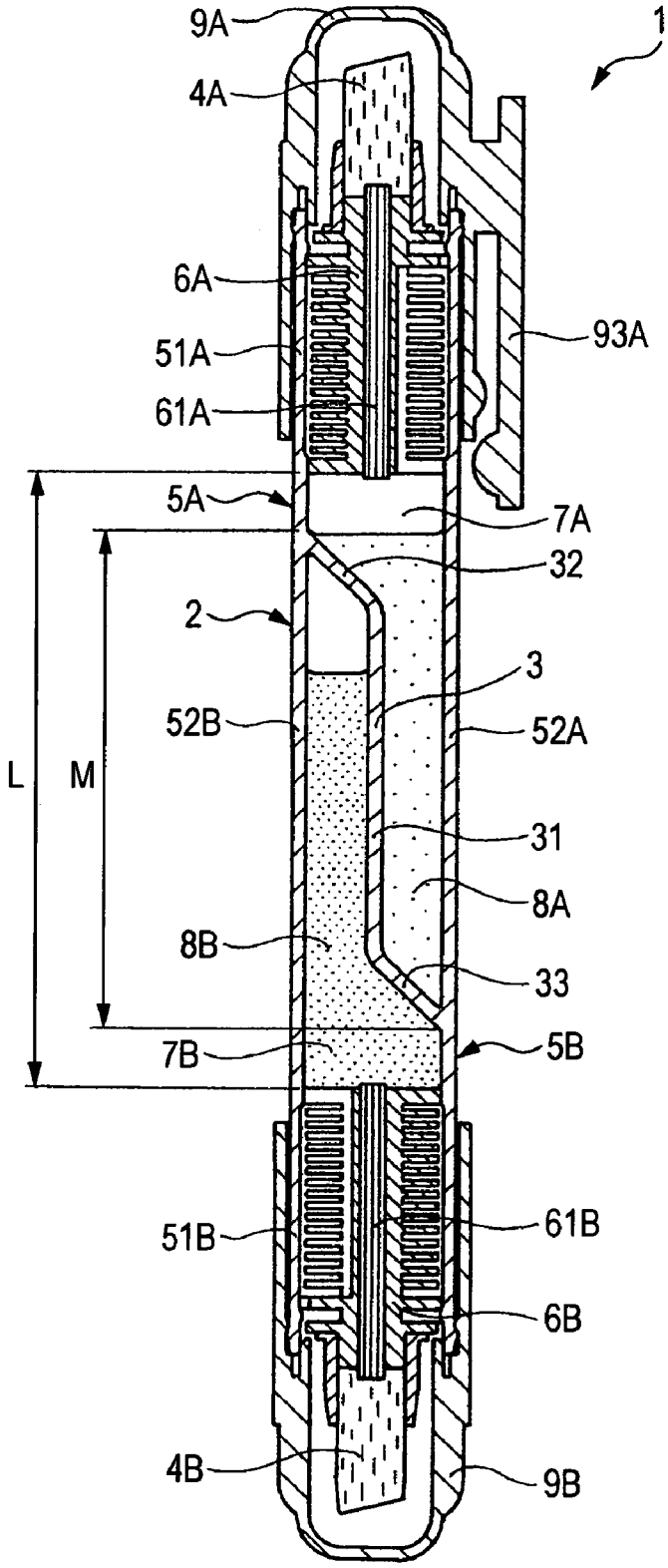
FIG. 2 is a longitudinal sectional view showing FIG. 1.
Figure 3:
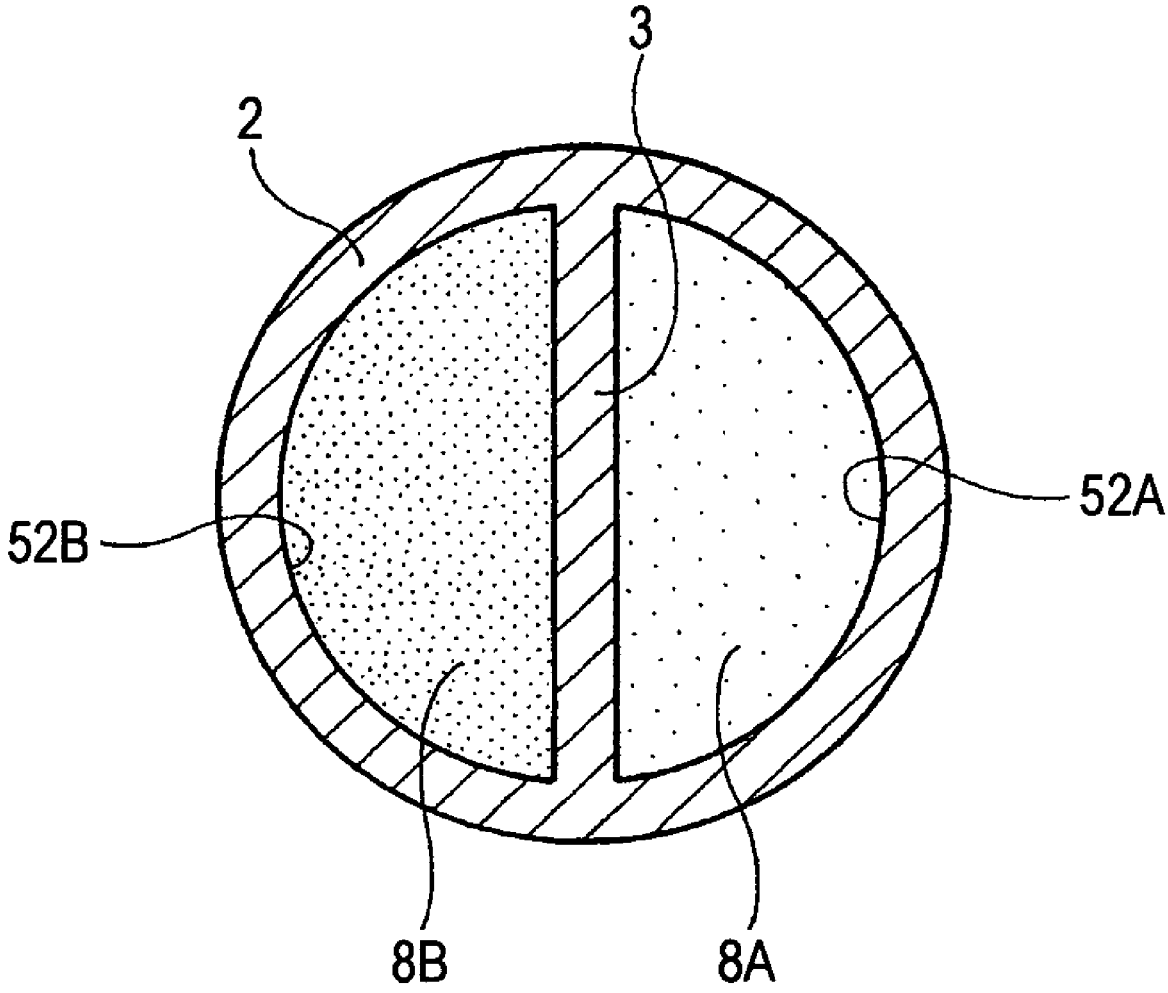
FIG. 3 is an enlarged sectional view taken along line A-A in FIG. 1.
Figure 4:
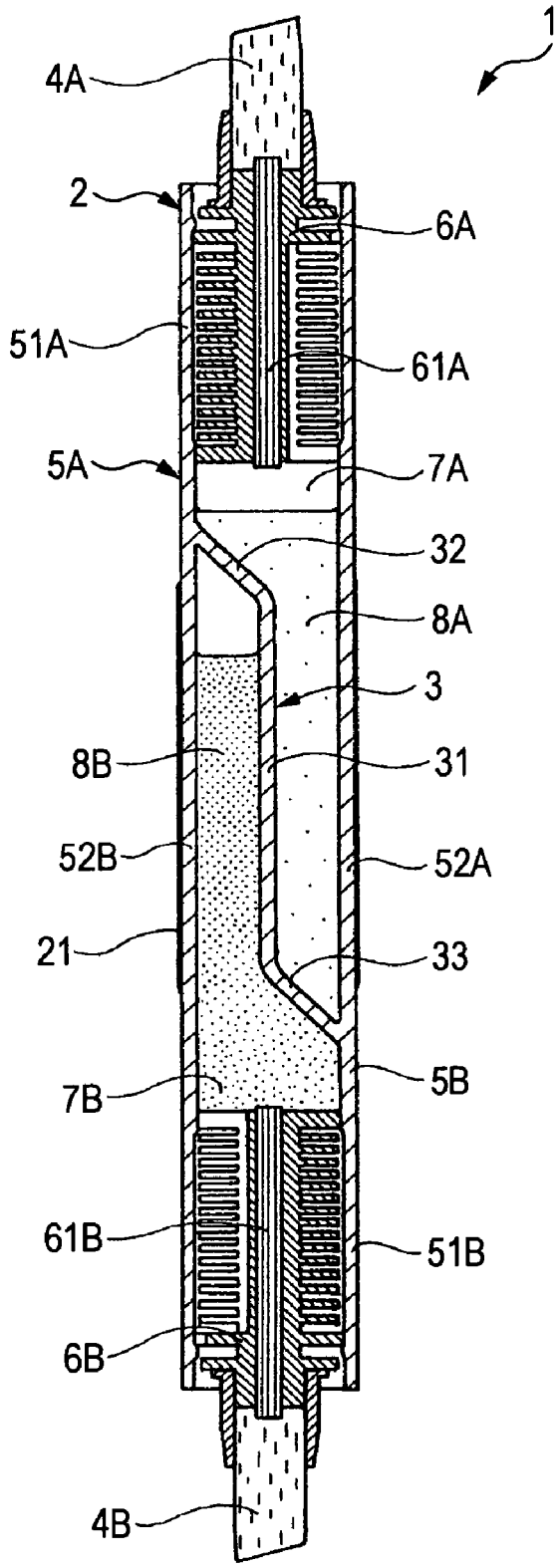
FIG. 4 is a longitudinal sectional view showing the writing instrument body of FIG. 1, with the cap removed.

An explanation will be made for the best modes for carrying out the present invention by referring to the drawings below.

First Embodiment

The first embodiment according to the present invention will be illustrated in FIG. 1 to 9.

The double-head writing instrument 1 of the present embodiment is comprised of the barrel 2 provided with the first nib 4A and the second nib 4B essentially at both ends. The first cap 9A is detachably attached to the first nib 4A of the barrel 2 and the second cap 9B is detachably attached to the second nib 4B of the barrel 2.

The barrel 2 is a cylindrical body with both ends opened and prepared by injection molding of transparent or translucent synthetic resin (namely, synthetic resins of colorless transparent or non-colored transparent synthetic resins). The partition 3 is formed inside the barrel 2. The first ink tank 5A opened at one end of the barrel 2 and the second ink tank 5B opened at the other end of the barrel 2 are formed inside the barrel 2. The first ink tank 5A and the second ink tank 5B are not communicatively connected through and are blocked so that the ink does not flow in or out of each other through the partition 3. The transparent or translucent synthetic resin may include, for example, polypropylene.

The partition 3 is constructed to extend in the longitudinal axis of the writing instrument that is, the partition 3 is constructed to extend at least parallel to the longitudinal axis or to slant toward the longitudinal axis. More particularly, one end of the partition 3 is connected with the inner surface of the side wall of the barrel 2 in the vicinity of the first ink-retaining member 6A, and the other end of the partition 3 is connected with the inner surface of the side wall of the barrel 2 in the vicinity of the second ink-retaining member 6B. In the present embodiment, the partition 3 comprises the central wall 31 extending approximately parallel to the longitudinal axis, the first bottom wall 32 and the second bottom wall 33 slanting to the longitudinal axis extended from the both ends of the central wall 31. The first bottom wall 32 is integrally connected with the inner surface of the side wall of the barrel 2 in the vicinity of the first ink-retaining member 6A, and the second bottom wall 33 is integrally connected with the inner surface of the wall of barrel 2 in the vicinity of the second ink-retaining member 6B. The first ink reservoir 7A and the second ink reservoir 7B are provided as a two-layered structure overlapping each other through the partition 3 in a radial direction.

The first bottom wall 32 and the second bottom wall 33 are provided with the inclined planes 321 and 331 slanting toward the longitudinal axis on both sides, which correspond the inner surface of the first ink reservoir 7A provided between the first bottom wall 32 and the second bottom wall 33, and the inner surface of the second ink reservoir 7B provided between the first bottom wall 32 and the second bottom wall 33. It is preferable that the first bottom wall 32 and the second bottom wall 33 are provided on both sides of the partition 3 in terms of increasing the inclined planes 321 and 331. The first bottom wall 32 of the first ink-retaining member 6A and the second bottom wall 33 of the second ink-retaining member 6B are designed to have the same slanting direction, more preferably to have the same slanting angle with respect to the longitudinal axis.

The inclined plane 321 on the first bottom wall 32 and the inclined plane 331 on the second bottom wall 33 are of a flat surface or conical surface. The central wall 31 is formed at the center of the interior of the barrel 2 to divide the interior of the barrel 2 into halves. The central wall 31 extending in the direction of the longitudinal axis is formed in parallel with the longitudinal axis but may slant toward the longitudinal axis.

Figure 7A:
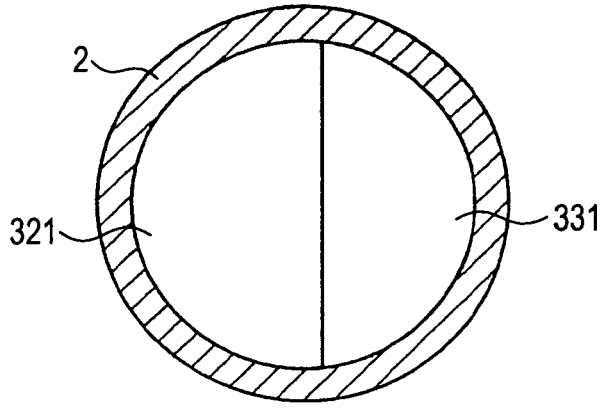
FIG. 7A is a sectional view taken along line F-F in FIG. 5.
Figure 7B:
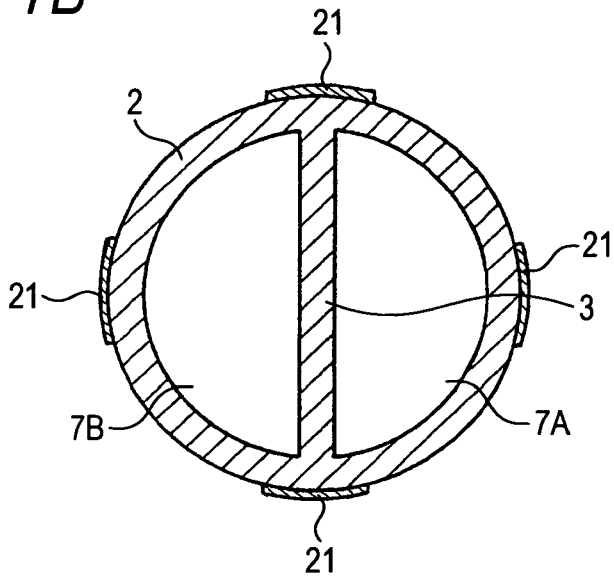
FIG. 7B is a sectional view taken along line E-E in FIG. 5.
Figure 7C:
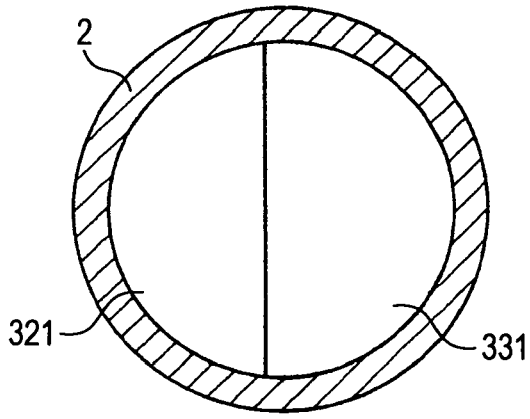
FIG. 7C is a sectional view taken along line G-G in FIG. 5.

As illustrated in FIG. 7A, when the partition 3 is viewed from the opening side of the first ink tank 5A, the inclined plane 321 of the first bottom wall 32 in the vicinity of the first ink-retaining member 6A and the inclined plane 331 of the second bottom wall 33 in the vicinity of the second ink-retaining member 6B are visually recognized simultaneously, and the inclined planes 321 and 331 are visually recognized on an almost entire inner surface of the partition 3. Similarly, as illustrated in FIG. 7(*c*), when the partition 3 is viewed from the opening side of the second ink tank 5B, the inclined plane 321 of the first bottom wall 32 in the vicinity of the first ink-retaining member 6A and the inclined plane 331 of the second bottom wall 33 in the vicinity of the second ink-retaining member 6B are visually recognized simultaneously, and the inclined planes 321 and 331 are visually recognized on an almost entire inner surface of the partition 3.

Figure 5:
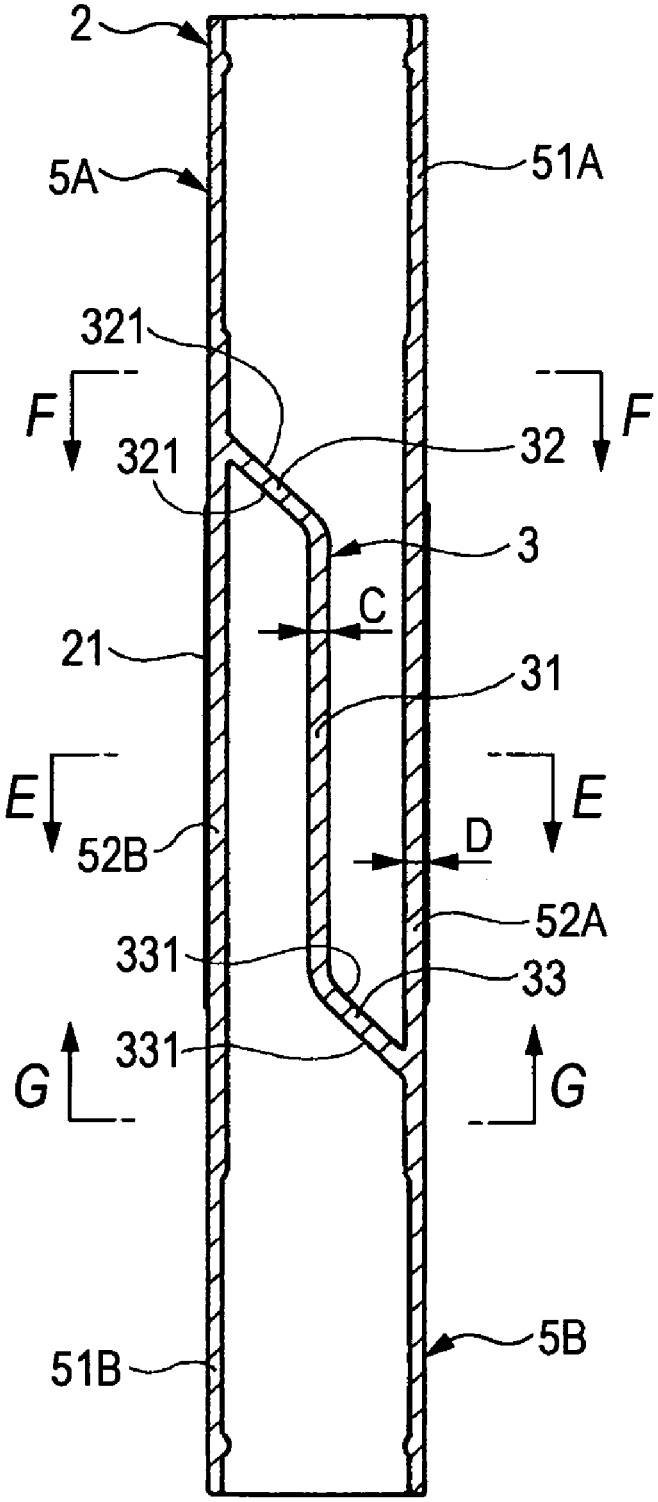
FIG. 5 is a longitudinal sectional view showing the barrel in FIG. 1.
Figure 6:
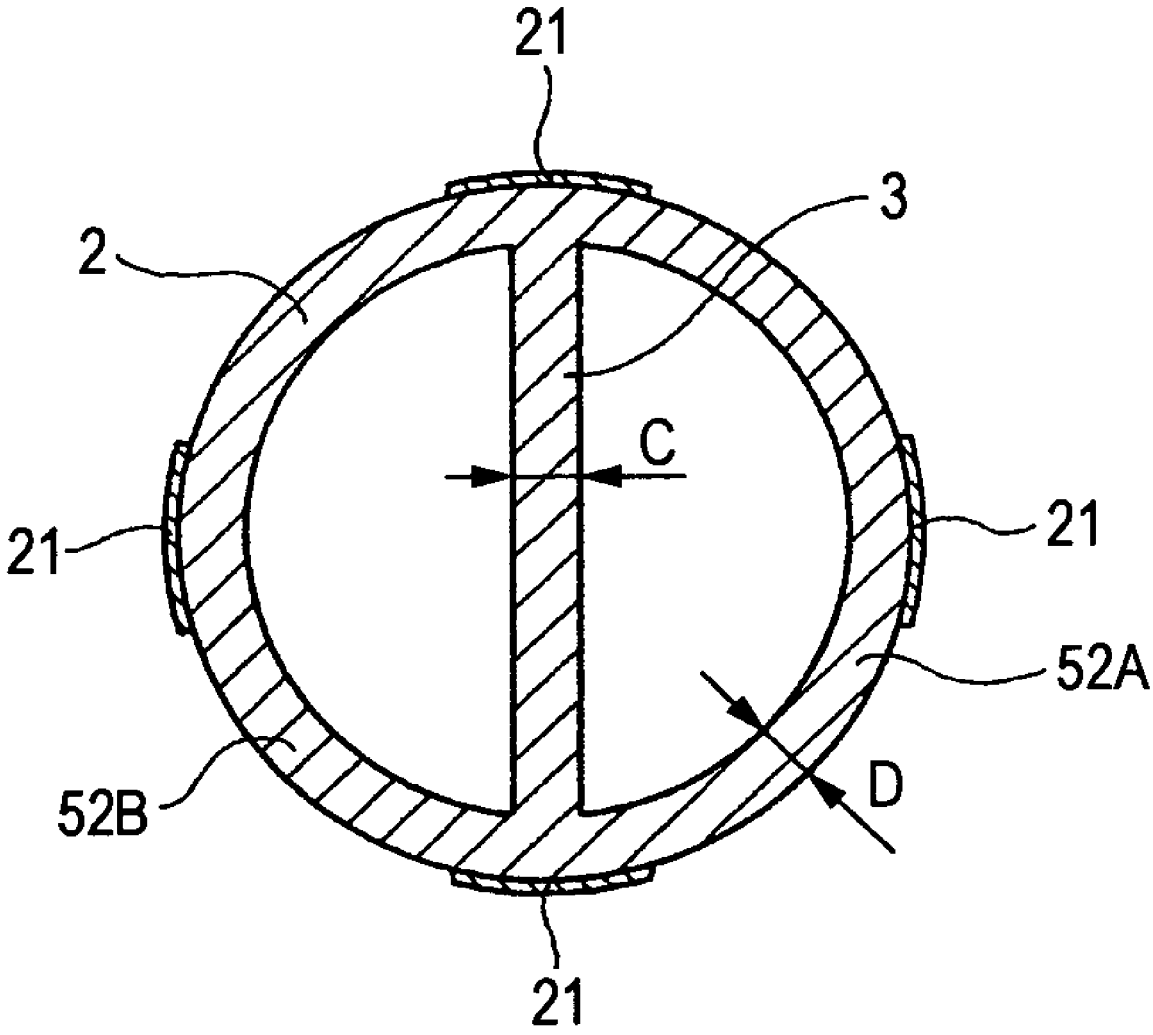
FIG. 6 is an enlarged sectional view taken along line E-E in FIG. 5.

As illustrated in FIG. 5 and FIG. 6 of the present embodiment, the thickness C of the partition 3, which are thickness of the central wall 31, the first bottom wall 32 and the second bottom wall 33, is set to be in the range of 0.7 mm to 2.0 mm. The thickness D of the side wall of the barrel 2 connected with the partition 3 is set to be in the range of 1.5 mm to 2.0 mm. The ratio of thickness C of the partition 3 to thickness D of the side wall of the barrel 2 (C/D) is set to be in the range of 0.35 to 1.33. Accordingly, when forming the barrel 2, such a situation can be prevented that a mold core pin forming the partition 3 bent into inner radial direction and holes are formed on the partition 3. Also, it is prevented from occurring sink formed on the outer surface of the side wall of the barrel 2.

The outer surface of the side wall of the barrel 2 connected with the partition 3 is provided with the printed layer 21 indicating lettering, patterns, bar codes and others. The printed layer 21 maybe obtained, for example, by screen printing, pad printing, offset printing or transferring printing. The outer surface of the side wall of the barrel 2 connected with the partition 3 can be provided with the appropriate printed layer 21 free from any printing failure since sink occurrence is prevented during molding. The printed layer 21 is formed so that the first ink tank 5A in an overlapped state, which corresponds the first ink reservoir 7A, and the second ink tank 5B, which corresponds the second ink reservoir 7B, can be visually recognized from the outside. In the present embodiment, the printed layer 21 is formed partially on the outer surface of the side wall of the barrel 2 connected with the partition 3. Particularly, in the present invention, the outer surface of the side wall of the barrel 2 connected with the partition 3 is almost free from sink. Thus, there will be no possibility of printing failure, even if the printed layer 21 is formed on the outer surface of the side wall of the barrel 2 having the joint part with the partition 3, which may often develop sink marks.

The first ink tank 5A is comprised of the first large-diameter part 51A opened forward in a transversely circular shape and the first small-diameter part 52A continuously provided posterior to the first large-diameter part 51A in a transversely semicircular shape. The first ink-retaining member 6A is jointed into the large-diameter part 51A of the first ink tank 5A. The first ink reservoir 7A is formed inside the first ink tank 5A posterior to the first ink-retaining member 6A, which corresponds a space between the large-diameter part 51A posterior to the first ink-retaining member 6A and the small-diameter part 52A.

Similarly, the second ink tank 5B is comprised of the second large-diameter part 51B opened forward in a transversely circular shape and the second small-diameter part 52B continuously provided posterior to the second large-diameter part 51B in a transversely semicircular shape. The second ink-retaining member 6B is jointed into the large-diameter part 51B of the second ink tank 5B. The second ink reservoir 7B is formed inside the second ink tank 5B posterior to the second ink-retaining member 6B, which corresponds a space between the large-diameter part 51B posterior to the second ink-retaining member 6B and the small-diameter part 52B.

The small-diameter part 52A of the first ink tank 5A and the small-diameter part 52B of the second ink tank 5B overlap each other as a two-layered structure in a diametric dimension through the partition 3. The overlapped part of the small-diameter part 52A of the first ink tank 5A with the small-diameter part 52B of the second ink tank 5B is set to be approximately the same in outer diameter with the large-diameter part 51A of the first ink tank 5A with the large-diameter part 51B of the second ink tank 5B.

The first ink-retaining member 6A is a member that temporarily retains the ink spilled depending on an increase in pressure within the first ink reservoir 7A, and an injection molding of synthetic resins (for example, ABS resin) with a plurality of circular comb teeth in the present embodiment. The first nib 4A is provided at the front end of the first ink-retaining member 6A. An axial center aperture is provided through the axial center of the first ink-retaining member 6A, and the ink guiding core 61A is attached into the axial center aperture. The front end of the ink guiding core 61A is connected with the first nib 4A, and the rear end of the ink guiding core 61A is connected with the first ink reservoir 7A. The ink guiding core 61A may include a fiber modification, a porous body or an extrusion molding of synthetic resin having an axial capillary channel in the longitudinal axis, and a resinated fiber product (for example, resinated product of polyester fiber) is used in the present embodiment.

Similarly, the second ink-retaining member 6B is a member that temporarily retains the ink spilled depending on an increase in pressure within the second ink reservoir 7B, and an injection molding of synthetic resins (for example, ABS resin) with a plurality of circular comb teeth in the present embodiment. The second nib 4B is provided at the front end of the second ink-retaining member 6B. An axial center aperture is provided through the axial center of the second ink-retaining member 6B, and the ink guiding core 61B is attached into the axial center aperture. The front end of the ink guiding core 61B is connected with the second nib 4B, and the rear end of the ink guiding core 61B is connected with the second ink reservoir 7B. The ink guiding core 61B may include a fiber modification, a porous body or an extrusion molding of synthetic resin having an axial capillary channel, and a resinated fiber product (for example, resinated product of polyester fiber) is used in the present embodiment.

The first ink-retaining member 6A is colored approximately in the same color with the first ink 8A of the first ink reservoir 7A. More particularly, the first ink-retaining member 6A is formed by a synthetic resin material of approximately the same color with the first ink 8A of the first ink reservoir 7A. The second ink-retaining member 6B is colored approximately in the same color with the second ink 8B of the second ink reservoir 7B. More particularly, the second ink-retaining member 6B is formed by a synthetic resin material of approximately the same color with the second ink 8B of the second ink reservoir 7B. Since the barrel 2 is made of transparent or translucent material, ink color of the first ink-retaining member 6A and that of the second ink-retaining member 6B can be visually recognized outside the barrel 2.

The first ink 8A is reserved in the first ink reservoir 7A and the second ink 8B is reserved in the second ink reservoir. A combination of different colors is adopted for the first ink 8A and the second ink 8B. Since the barrel 2 is made of transparent or translucent material, the first ink 8A in the first ink reservoir 7A and the second ink 8B in the second ink reservoir 7B can be visually recognized from the outside. For the first ink 8A or the second ink 8B used in the present embodiment, an ink containing fluorescent pigments or fluorescent dyes are adopted, thereby providing a double-head writing instrument 1 excellent in color development and highly-attractive in appearance. The combination of the first ink 8A and the second ink 8B may includes for example, combinations of fluorescent yellow and fluorescent pink, fluorescent yellow and fluorescent orange, fluorescent yellow and fluorescent green, fluorescent pink and fluorescent orange, fluorescent pink and fluorescent green, fluorescent yellow and fluorescent blue, fluorescent yellow and fluorescent violet and so on, which are preferably pleasing in appearance in coloration.

The first ink 8A and the second ink 8B can be visually recognized through the partition 3 as a two-layer structure overlapped in the radial direction. The filling quantity of the first ink 8A and that of the second ink 8B in the first ink reservoir 7A and the second ink reservoir 7B are set so that the ink always exists in the small-diameter part 52A of the first ink tank 5A and the small-diameter part 52B of the second ink tank 5B, even when either the first nib 4A or the second nib 4B is pointed downward. Whereby, when the first nib 4A or the second nib 4B is pointed downward, the first ink 8A and the second ink 8B can be more assuredly recognized through the partition 3 from side to side (namely, in the radial direction) as a two-layer overlapped structure.

Further, the axial length M of the partition 3 constituting the overlapped part is preferably set to be at least 20% or more of the longitudinal axis length L defined between the rear end of the first ink-retaining member 6A and the rear end of the second ink-retaining member 6B (more preferably 50% or more and further more preferably 70% or more), in terms of an easy visual recognition of two colors. It is also preferable in terms of an easy recognition of two colors that the filling quantity of the first ink 8A and that of the second ink 8B are set so that the axial length of the overlapped part of the first ink 8A with the second ink 8B, with either nib pointed downward, is set to be at least 20% or more of the axial length between the rear end of the first ink-retaining member 6A and the rear end of the second ink-retaining member 6B.

The first nib 4A includes a fiber modification, brush body or porous body. When the nib 4A is impregnated with the first ink 8A in the first ink reservoir 7A, the color of the first ink 8A can be visually recognized from the outside and the first nib 4A is colored by the first ink 8A. Similarly, the nib 4B includes a fiber modification, brush body or porous body. When the nib 4B is impregnated with the second ink 8B in the second ink reservoir 7B, the color of the second ink 8B can be visually recognized from the outside and the second nib 4B is colored by the second ink 8B. In the present embodiment, the first nib 4A and the second nib 4B are identically shaped and made of a resinated fiber product (for example, resinated product of polyester fiber).

In addition to the above, the first nib 4A and the second nib 4B may include the following examples such as a combination of two fiber modifications different in configuration, that of two ball-point pen tips, that of two brush tips, that of two porous body tips, that of two metal fountain-pen type nibs provided with a slit at the tip, that of two pen tips made of extrusion moldings of plastic resin (plastic pen tip), that of a fiber modification with a porous body tip, that of a fiber modification with a plastic pen tip, that of a fiber modification with a brush tip, that of a fiber modification with a fountain-pen nib, that of a fiber modification with a ball-point tip, that of a porous body tip with a plastic pen tip, that of a porous body tip with a brush tip, that of a porous body tip with a fountain-pen nib, that of a porous body tip with a ball point tip, that of a plastic pen tip with a brush tip, that of a plastic pen tip with a fountain pen nib, that of a plastic pen tip with a ball point tip, that of a brush tip with a fountain pen nib, that of a brush tip with a ball point tip and that of a fountain pen nib with a ball point tip. It is preferable that the outer surface of the ball point tip is colored in the same color with the ink in the first ink reservoir 7A and the second ink reservoir 7B. Further, the nib of the present invention includes a nib holder interposed between the nib and the barrel 2.

Figure 8:
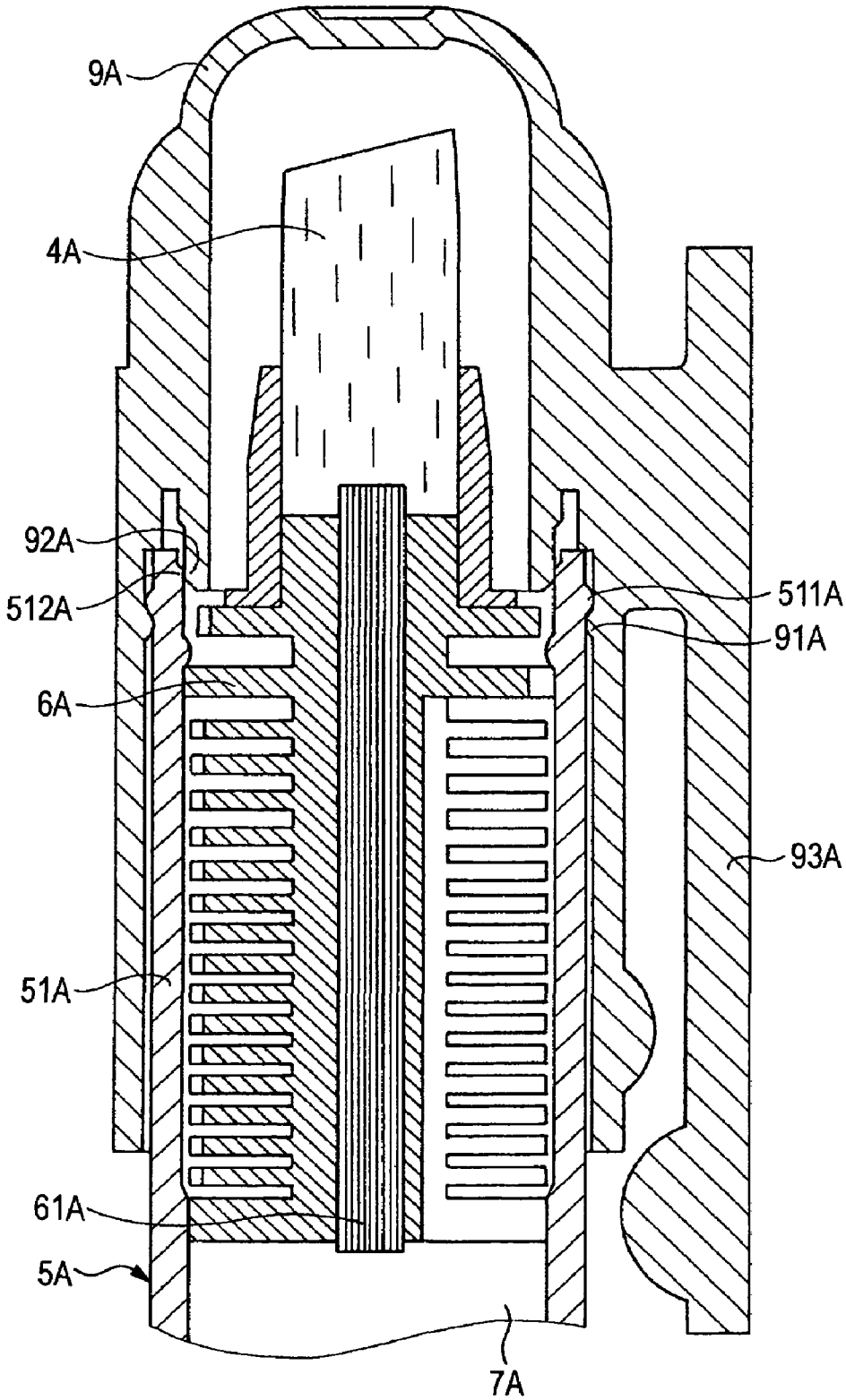
FIG. 8 is an enlarged longitudinal sectional view showing the first nib in FIG. 2.
Figure 9:
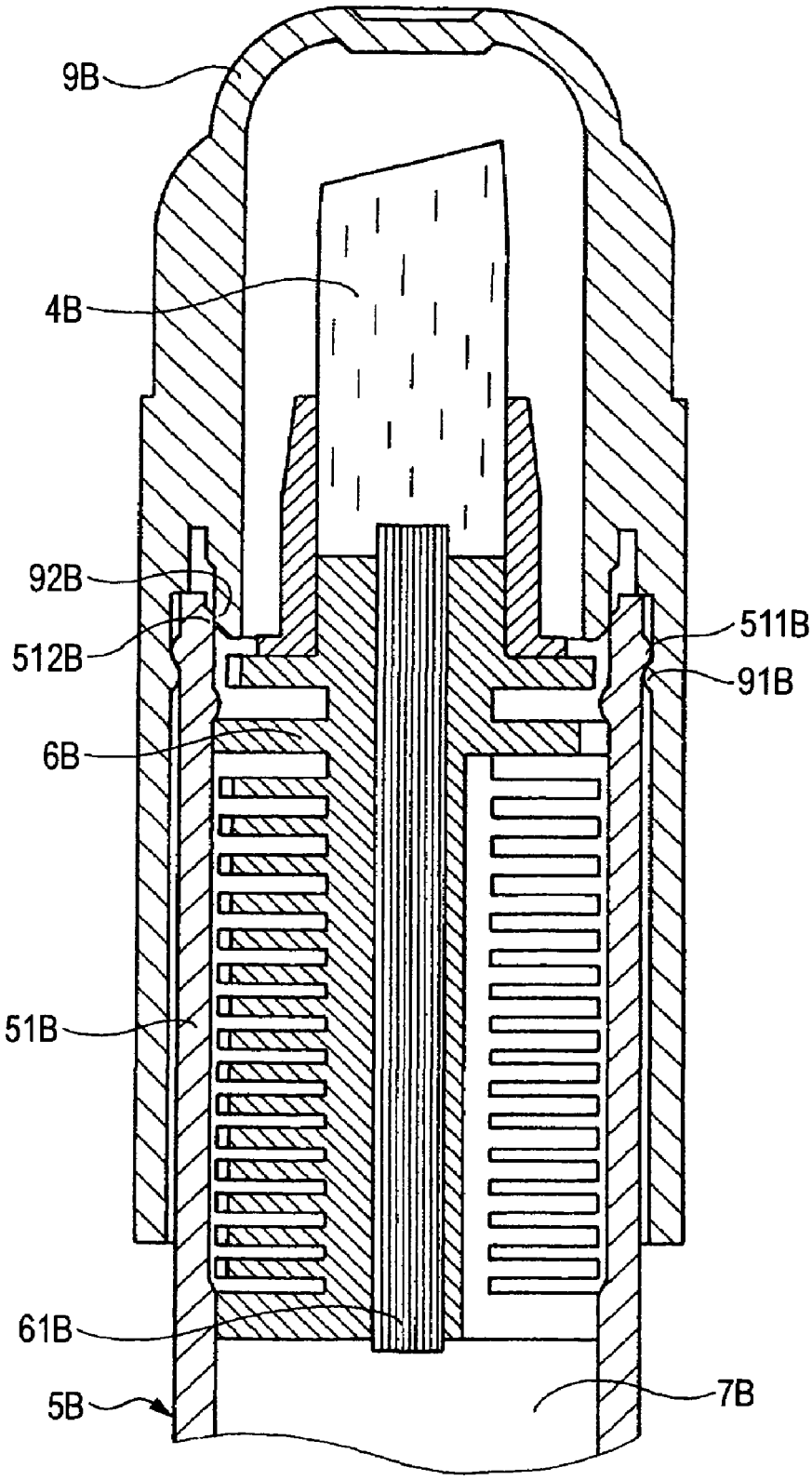
FIG. 9 is an enlarged longitudinal sectional view showing the second nib in FIG. 2.

As illustrated in FIG. 8, the front end of the large-diameter part 51A of the first ink tank 5A is provided on the outer circumferential surface with the outward projection 511A (overridden engagement part) and the inner circumferential surface with the annular air-tight part 512A (air-tight sealed part). As illustrated in FIG. 9, similarly, the front end of the large-diameter part 51B of the second ink tank 5B is provided on the outer circumferential surface with the outward projection 511B (overridden engagement part) and the inner surface with the annular air-tight part 512B (air-tight sealed part).

Since the first large-diameter part 51A and the second large-diameter part 51B do not have the partition 3 therein, the large-diameter parts 51A and 51B are not affected by their outer circumferential surfaces or inner circumferential surfaces by sink occurrence during molding. Therefore, the first large-diameter part 51A and the second large-diameter part 51B are not affected by the front ends by development of sink marks. Accordingly, the engagement part on the front end of the first large-diameter part 51A, which corresponds overridden engagement part 511A and air-tight part 512A, and the engagement part on the front end of the second large-diameter part 51B, which corresponds overridden engagement part 511B and air-tight part 512B, are provided with an appropriate shape free from sink. Further, the present invention includes the construction in which the air-tight sealed parts 512A and 512B are directly provided on the front end of the first large-diameter part 51A and on the front end of the second large-diameter part 51B as shown in constructions illustrated in FIG. 8 and FIG. 9, and also the construction in which annular seal members are provided on the inner circumferential surface of the front end of the first large-diameter part 51A and on inner circumferential surface of the front end of the second large-diameter part 51B. Since the air-tight sealed part consisting of the annular seal member does not have sink marks on the front ends of the first large-diameter part 51A or the second large-diameter part 51B, an area at which the air-tight sealed part is attached is provided with a sufficient sealing.

The first cap 9A is a bottomed cylindrical body with one end closed and the other end opened and made by injection molding of transparent or translucent synthetic resin that is, colorless transparent or non-colored transparent synthetic resins. The outward projection 511A of the first ink tank 5A, the outward projection 511B of the second ink tank 5B, the inward projection 91A that can override and engage, and the annular seal part 92A sealable with the annular air-tight part 512A of the first ink tank 5A and the annular air-tight part 512B of the second ink tank 5B are formed integrally on the inner surface of the first cap 9A. The transparent or translucent synthetic resin include polypropylene.

Similarly, the second cap 9B is a bottomed cylindrical body with one end closed and the other end opened, and made by injection molding of transparent or translucent synthetic resin that is, colorless transparent or non-colored transparent synthetic resins. The outward projection 511A of the first ink tank 5A, the outward projection 511B of the second ink tank 5B, the inward projection 91B that can override and engage, and the annular seal part 92B sealable with the annular air-tight part 512A of the first ink tank 5A and the annular air-tight part 512B of the second ink tank 5B are formed integrally on the inner surface of the second cap 9B. The transparent or translucent synthetic resin include polypropylene.

More particularly, the joint part of the first cap 9A, which corresponds an inward projection 91A and an annular seal part 92A, is identical in configuration with the joint part of the second cap 9B, which corresponds an inward projection 91B and an annular seal part 92B. Also, the joint part of the first ink tank 5A, which corresponds an outward projection 511A and an annular air-tight part 512A, is identical in configuration with the joint part of the second ink tank 5B, which corresponds outward projection 511B and annular air-tight sealed part 512B. Therefore, the first cap 9A can be attached on the first ink tank 5A having the first nib 4A or on the second ink tank 5B having the second nib 4B, where as the second cap 9B can be attached either on the ink tank 5A having the first nib 4A or on the second ink tank 5B having the second nib 4B. Namely, the first cap 9A can be attached on the barrel 2 either on the first nib 4A side or on the second nib 4B, whereas the second cap 9B can be attached on the barrel 2 either on the first nib 4A side or on the second nib 4B.

The first cap 9A and the second cap 9B of the present embodiment are transparent single bodies constructed not to have the function of indicating ink color. Therefore, when a cap is attached either on the first nib 4A or the second nib 4B, they are not confused in recognizing the ink color but easily identifying the ink color, thereby eliminating the necessity for attaching the cap on the nib after distinguishing the first cap 9A from the second cap 9B. Further, in the present embodiment, the clip 93A is formed integrally on the outer surface of the first cap 9A, while the clip 93A is not formed on the outer surface of the second cap 9B. The first cap 9A having the clip 93A may be attached either on the first nib 4A or on the second nib 4B, for which users may select.

In the present embodiment, the partition 3 extended in the longitudinal axis, which corresponds the partition consisting of the central wall 31 and two bottom walls 32 and 33 on both ends, is positioned at the center of the longitudinal axis and between the rear end of the first ink-retaining member 6A and the rear end of the second ink-retaining member 6B so that the first ink reservoir 7A can be set to be equal in volume to the second ink reservoir 7B. The present invention will be made also by the second or the third embodiment wherein the first ink reservoir 7A may be different in volume from the second ink reservoir 7B.

Second Embodiment

Figure 10:
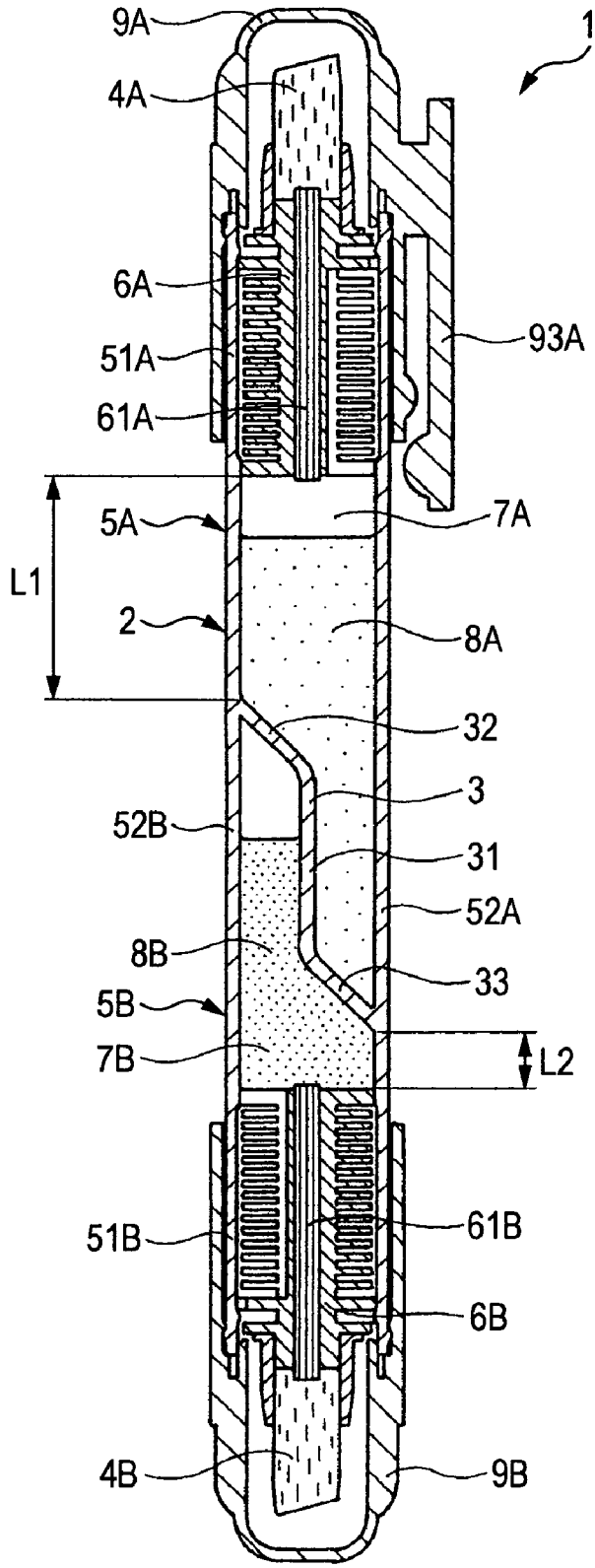
FIG. 10 is a longitudinal sectional view showing the double-head writing instrument of the second embodiment according to the present invention.

The second embodiment is illustrated in FIG. 10.

The present embodiment is different in position of the partition 3 from the first embodiment. More particularly, in the present embodiment, the distance L1 between the connected end of the partition 3 on the first nib 4A side and the rear end of the first ink-retaining member 6A is set to be longer than the distance L2 between the connected end of the partition 3 on the second nib 4B side and the rear end of the second ink-retaining member 6B, thereby the volume of the first ink reservoir 7A is set to be greater than that of the second ink reservoir 7B.

In the present embodiment, the first ink reservoir 7A is filled with the ink which is more frequently used by users (in other words, ink to be used faster) than the ink to be filled into the second ink reservoir 7B, thereby providing a double-head writing instrument, which can prevent users from using up the ink in one ink reservoir while the ink still remains in the other ink reservoir and can be therefore used for a long time. The first ink 8A or the second ink 8B used in the present embodiment is that in which fluorescent pigments or fluorescent dyes are contained. In inks containing the fluorescent pigments or fluorescent dyes, fluorescent yellow is generally considered to be used more frequently and the ink consumption rate is higher. Therefore, in the present embodiment, to be specific, fluorescent yellow is used as the first ink 8A, and any one of fluorescent pink, fluorescent orange, fluorescent green, fluorescent blue or fluorescent violet is used as the second ink 8B.

The volume ratio of the first ink reservoir 7A to the second ink reservoir 7B (volume of the first ink reservoir 7A to volume of the second ink reservoir 7B) is preferably 0.3 to 0.8 (more preferably 0.4 to 0.7). Where the above ratio is below 0.3, the length of the partition 3 in the longitudinal axis is not sufficiently set, thus making it difficult to set a sufficient two-layer construction in which the first ink reservoir 7A is overlapped with the second ink reservoir 7B through the partition 3. In contrast, where the above ratio exceeds 0.8, there will be almost no difference in volume between the first ink reservoir 7A and the second ink reservoir 7B. Description regarding other compositions is omitted since they are the same as those explained in the first embodiment.

Third Embodiment

Figure 11:
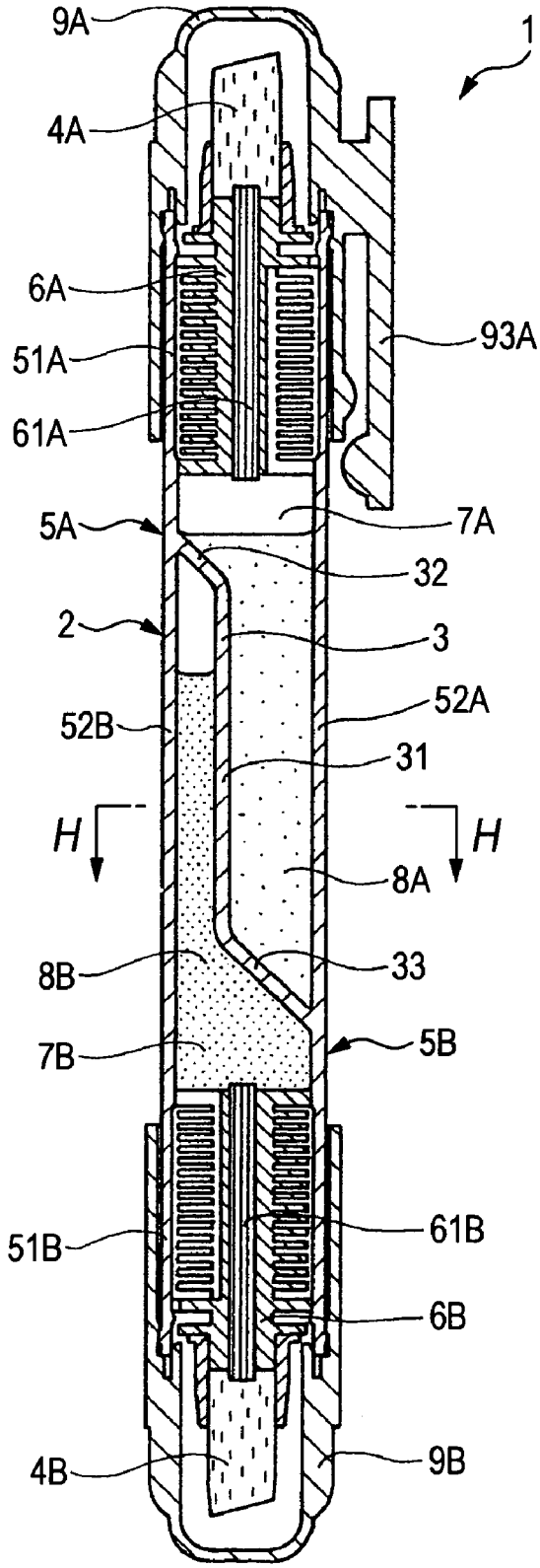
FIG. 11 is a longitudinal sectional view showing the double-head writing instrument of the third embodiment according to the present invention.
Figure 12:
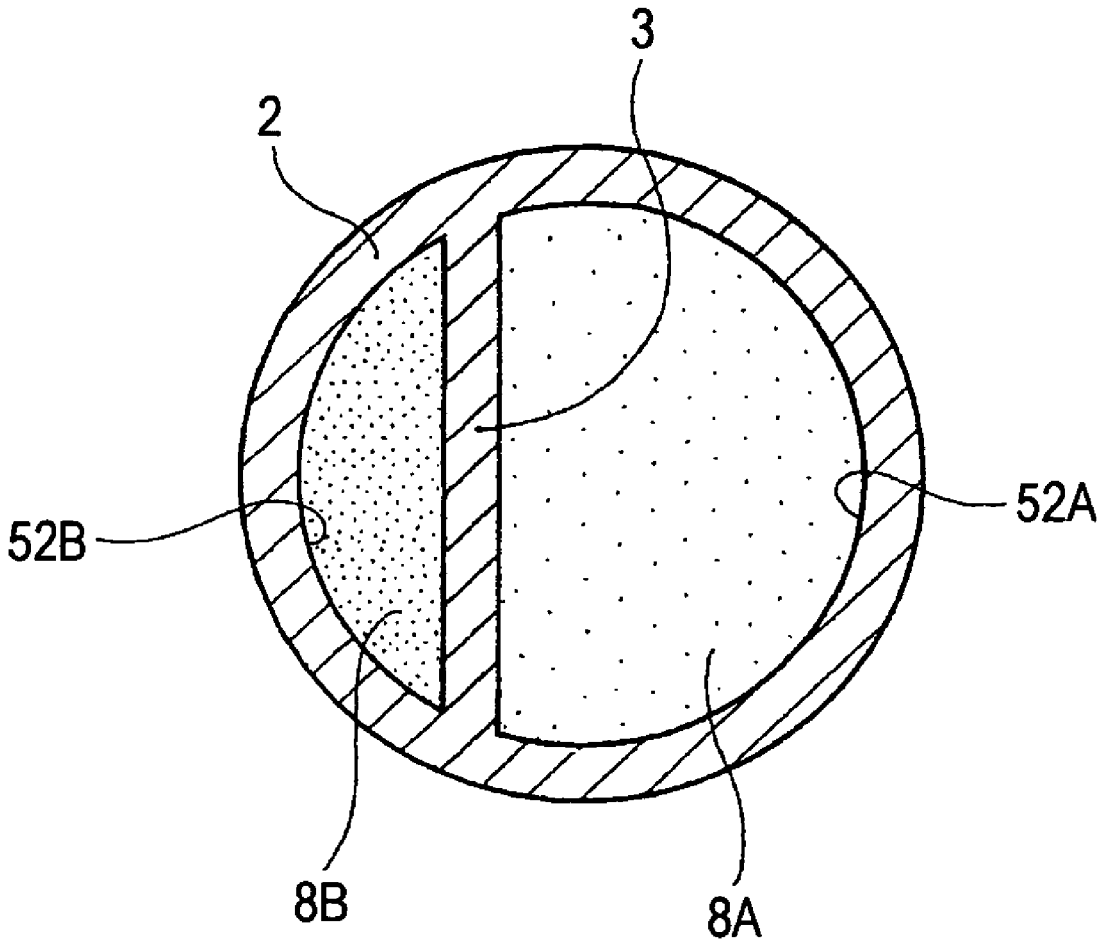
FIG. 12 is an enlarged sectional view taken along line H-H in FIG. 11.

The third embodiment is illustrated in FIG. 11 and FIG. 12. The present embodiment is different in position of the partition 3 from the first embodiment, as explained in the second embodiment. More particularly, in the first embodiment, the central wall 31 is positioned at the axial center of the barrel 2, whereas in the present embodiment, the central wall 31 is deviated from the axial center in the radial direction, and the second bottom wall 33 constituting the bottom wall of the first ink reservoir 7A is set to be larger in area than the first bottom wall 32 constituting the bottom wall of the second ink reservoir 7B. Therefore, the volume of the first ink reservoir 7A (namely, volume of the small-diameter part 52A) is set to be larger than the volume of the second ink reservoir 7B (volume of the small-diameter part 52B).

As well as the second embodiment, in the present embodiment, more frequently used ink (i.e. ink to be consumed at a higher rate) than the ink in the second ink reservoir 7B is filled into the first ink reservoir 7A, thereby preventing a user from using up ink in one ink reservoir while ink still remains in the other ink reservoir and providing a double-head writing instrument which can be used for a long time. In the present embodiment, the first ink 8A or the second ink 8B is the ink containing fluorescent pigments or fluorescent dyes. In the inks containing the fluorescent pigments or fluorescent dyes, fluorescent yellow is generally considered to be frequently used and consumed at a higher rate. Therefore, in the present embodiment, to be specific, fluorescent yellow is actually used as the first ink 8A and any of fluorescent pink, fluorescent orange, fluorescent green, fluorescent blue or fluorescent violet is used as the second ink 8B.

The volume ratio of the first ink reservoir 7A to the second ink reservoir 7B (volume of the first ink reservoir 7A to volume of the second ink reservoir 7B) is preferably 0.3 to 0.8 (more preferably 0.4 to 0.7). Where the above ratio is below 0.3, a mold core pin forming the inner surface of the small-diameter part 52B of the second ink tank 5B is made thin, thus making it difficult to form the small-diameter part 52B. In contrast, where the above ratio exceeds 0.8, there will be almost no difference in volume between the first ink reservoir 7A and the second ink reservoir 7B. Description regarding other compositions is omitted since they are the same as those explained in the first embodiment.

Fourth Embodiment

Figure 13:
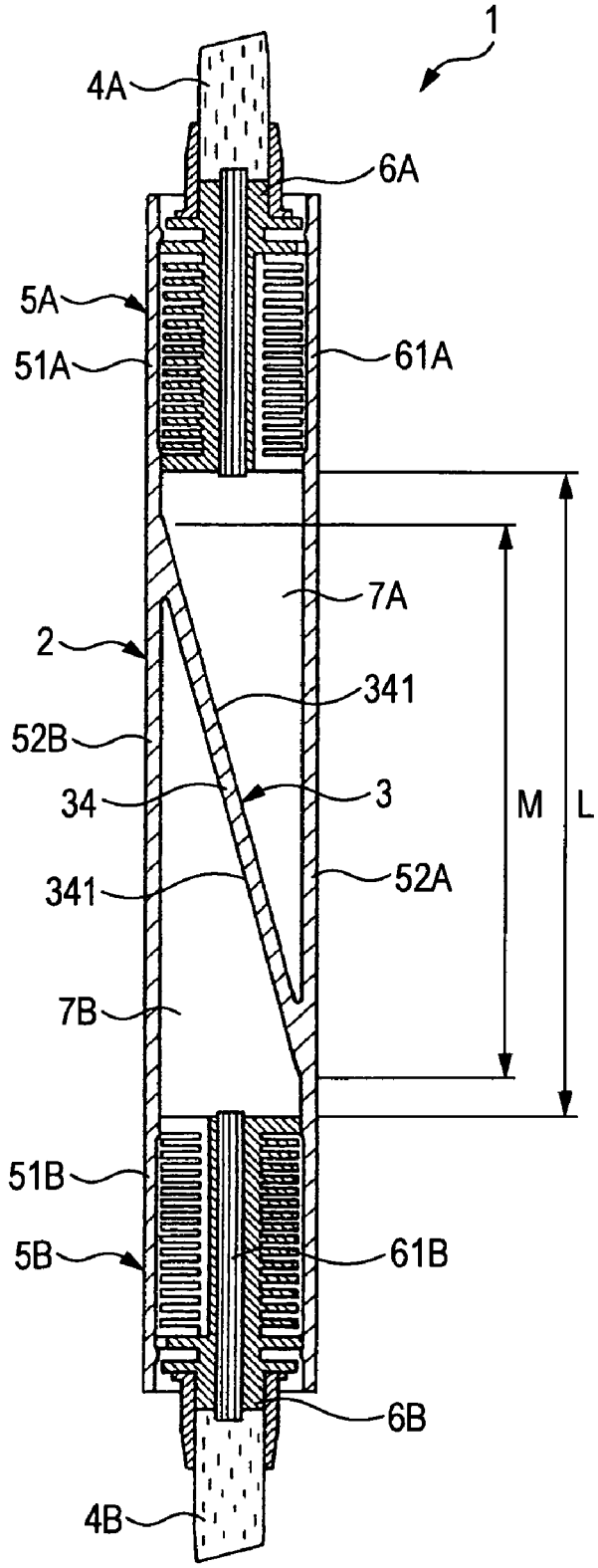
FIG. 13 is a longitudinal sectional view showing the double-head writing instrument of the fourth embodiment according to the present invention.

The fourth embodiment is illustrated in FIG. 13.

The double-head writing instrument 1 of the present embodiment is characterized in that the partition 3 includes one inclined wall 34 connected to one end with the side wall of the barrel 2 in the vicinity of the first ink-retaining member 6A and the side wall of the barrel 2 in the vicinity of the second ink-retaining member 6B.

The partition 3 is comprised of one inclined wall 34 with approximately the same thickness which slants at a certain gradient angle relative to the longitudinal axis. The inclined plane 341 is provided on both surfaces of the inclined wall 34 (i.e. the inner surface of the first ink reservoir 7A and the inner surface of the second ink reservoir 7B). The inclined plane 341 of the inclined wall 34 is a flat surface or a conical surface. The inclined plane 341 of the inclined wall 34 is constructed to have a certain gradient angle to the longitudinal axis and may be constructed to have plural gradient angles to the longitudinal axis.

The first ink tank 5A is comprised of the first large-diameter part 51A opened forward in a transversely circular shape and the first small-diameter part 52A continuously provided posterior to the first large-diameter part 51A and made smaller in diameter along the backward direction. The first ink-retaining member 6A is joined into the large-diameter part 51A of the first ink tank 5A. The first ink reservoir 7A is formed at a space formed by the rear part of the large-diameter part 51A of the first ink tank 5A posterior to the first ink-retaining member 6A and the small-diameter part 52A of the first ink tank 5A. Similarly, the second ink tank 5B is comprised of the second large-diameter part 51B opened forward in a transversely circular shape and the second small-diameter part 52B continuously provided posterior to the second large-diameter part 51B and made smaller in diameter along the backward direction. The second ink-retaining member 6B is joined into the large-diameter part 51B of the second ink tank 5B. The second ink reservoir 7B is formed at a space between the rear part of the large-diameter part 51B of the second ink tank 5B posterior to the second ink-retaining member 6B and the small-diameter part 52B of the second ink tank 5B.

When the partition 3 is viewed from the opening of the first ink tank 5A, the inclined plane 341 is visually recognized on an approximately entire area of the inner surface of the partition 3. Similarly, when the partition 3 is viewed from the opening of the second ink tank 5B, the inclined plane 341 is visually recognized on an approximately entire area of the inner surface of the partition 3. Explanation about other compositions is omitted since they are the same as those explained in the first embodiment.

Fifth Embodiment

Figure 14:
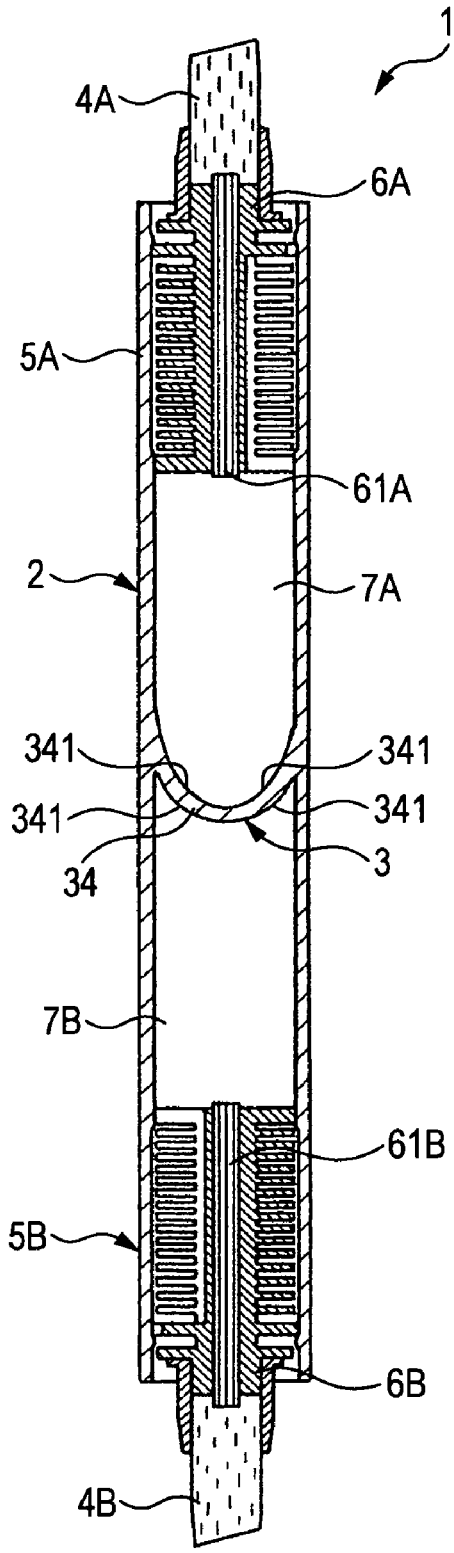
FIG. 14 is a longitudinal sectional view showing the double-head writing instrument of the fifth embodiment according to the present invention.

The fifth embodiment is illustrated in FIG. 14.

The double-head writing instrument 1 of the present embodiment is characterized in that the partition 3 are comprised of the inclined wall 34 both ends of which is connected with the side wall of the barrel 2 in the vicinity of the first ink-retaining member 6A and projected at the central part toward the second ink-retaining member 6B.

The partition 3 is comprised of the vertically-curved inclined wall 34 with approximately the same thickness, both ends of which slant toward the longitudinal axis. The inclined plane 341 is provided on both surfaces of the inclined wall 34 (i.e. the inner surface of the first ink reservoir 7A and the inner surface of the second ink reservoir 7B). The inclined plane 341 of the inclined wall 34 is a band-like curved surface, a conical surface or a spherical surface.

The first ink tank 5A is a transversely circular cylinder opened forward, and the bottom surface formed by the partition 3 is a vertically curved concave surface. The first ink-retaining member 6A is joined into the opening of the first ink tank 5A. The first ink reservoir 7A is formed inside the first ink tank 5A posterior to the first ink-retaining member 6A. Further, the second ink tank 5B is a transversely circular cylinder opened forward, and the bottom surface formed by the partition 3 is a vertically curved concave surface. The second ink-retaining member 6B is joined into the opening of the second ink tank 5B. The second ink reservoir 7B is formed inside the second ink tank 5B posterior to the second ink-retaining member 6B.

When the partition 3 is viewed from the opening of the first ink tank 5A, the inclined plane 341 is visually recognized on an approximately entire area of the inner surface of the partition 3. Similarly, when the partition 3 is viewed from the opening of the second ink tank 5B, the inclined plane 341 is visually recognized on an approximately entire area of the inner surface of the partition 3. Description regarding other compositions is omitted since they are the same as those explained in the first embodiment.

Sixth Embodiment

Figure 15:
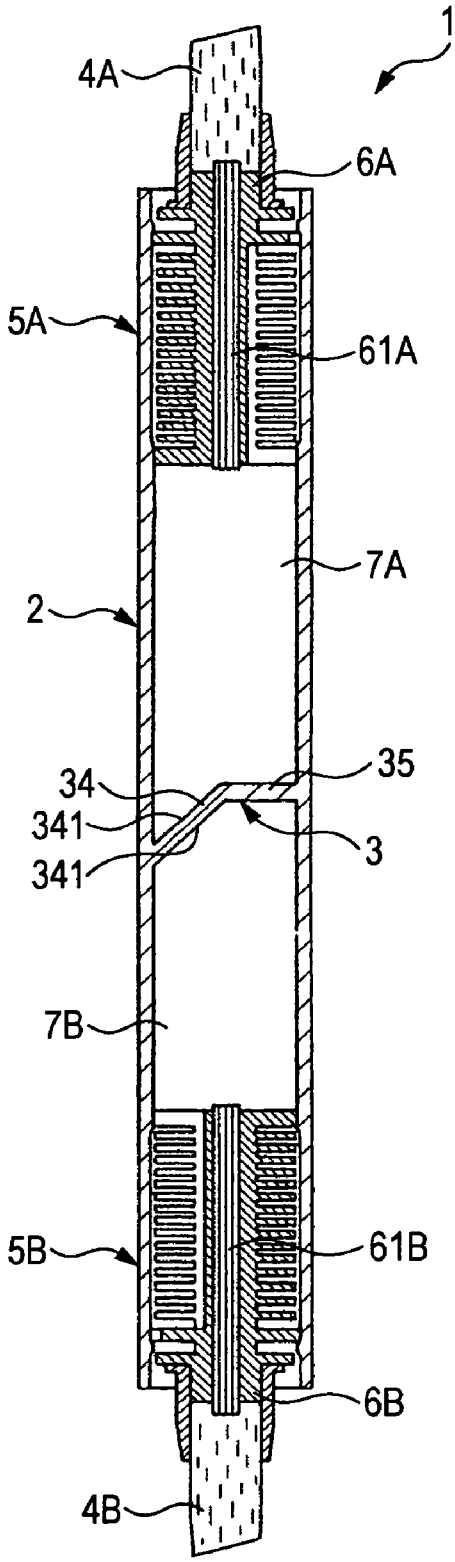
FIG. 15 is a longitudinal sectional view showing the double-head writing instrument of the sixth embodiment according to the present invention.
Figure 16:
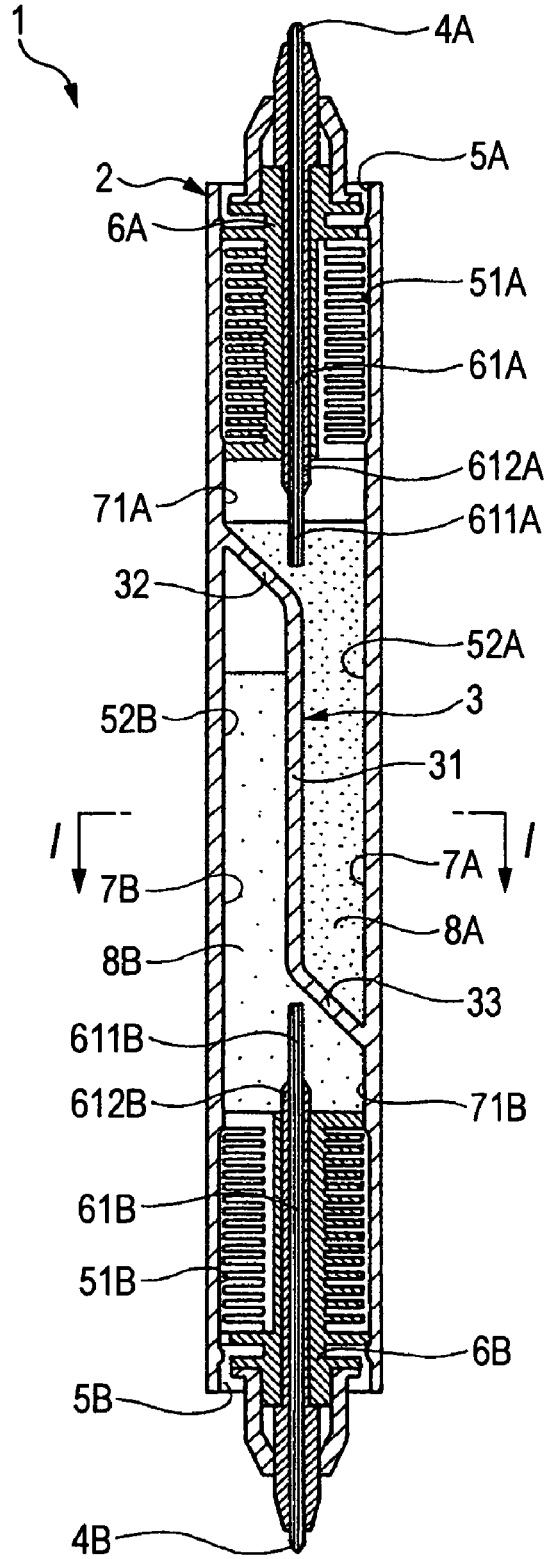
FIG. 16 is a longitudinal sectional view showing the double-head writing instrument of the seventh embodiment according to the present invention, with the first nib pointed upward.
Figure 17:
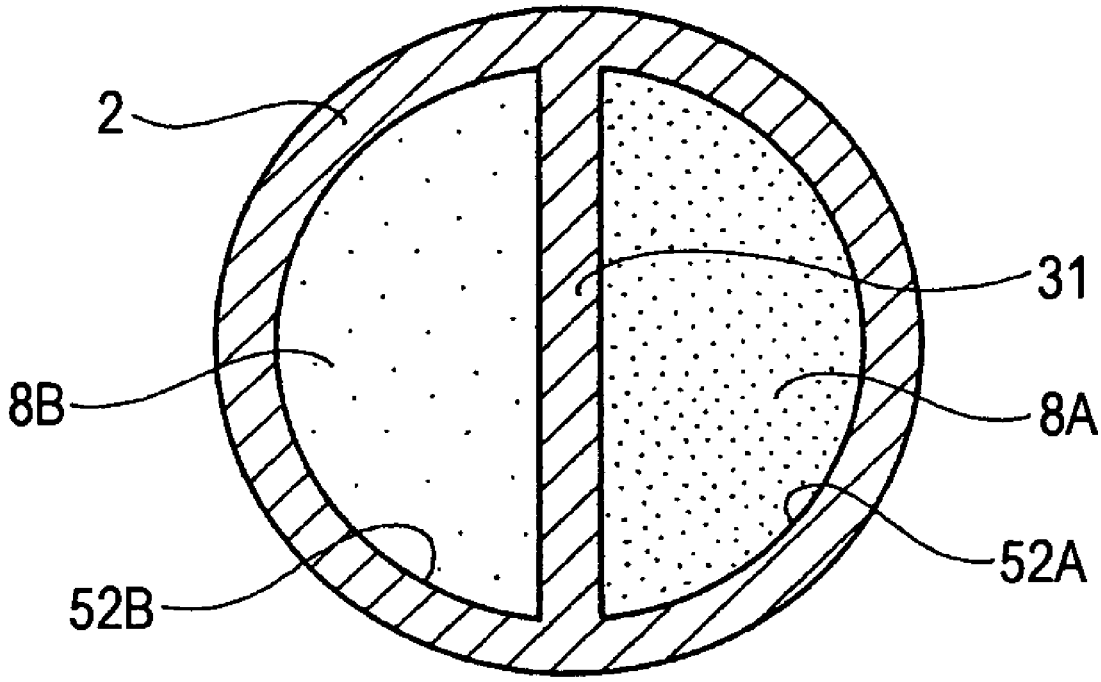
FIG. 17 is an enlarged sectional view taken along line I-I in FIG. 16.
Figure 18:
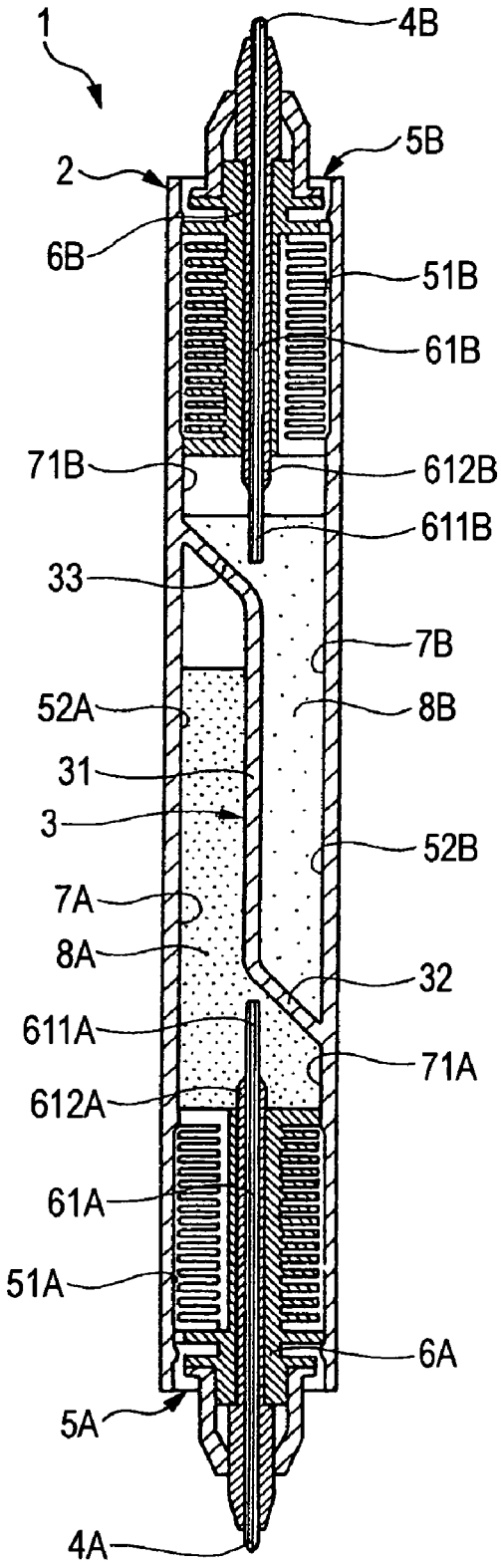
FIG. 18 is a longitudinal sectional view showing the writing instrument shown in FIG. 16, with the second nib pointed upward.
Figure 19:
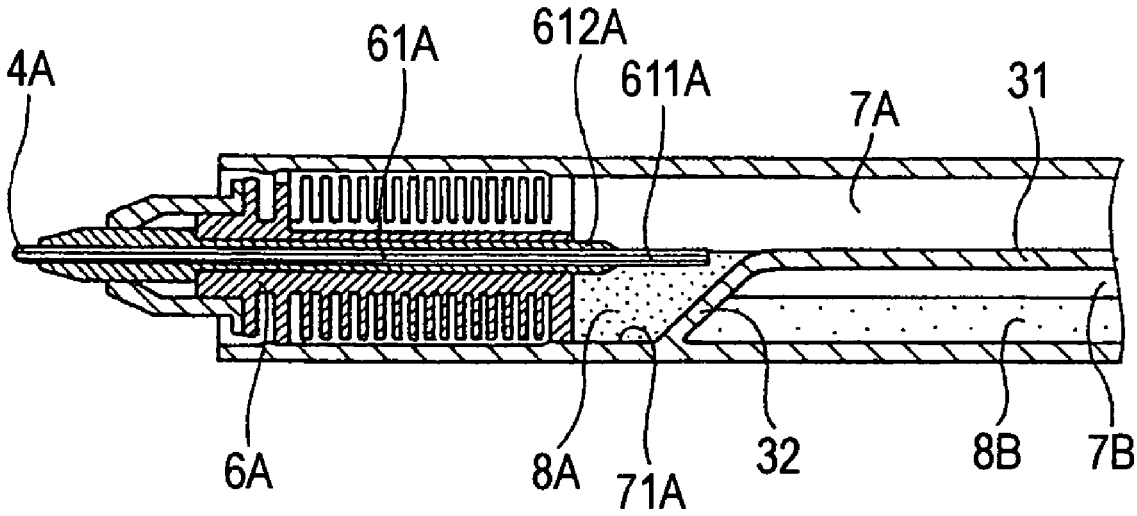
FIG. 19 is a longitudinal sectional view showing the writing instrument shown in FIG. 16, with the first nib kept horizontal.

The sixth embodiment is illustrated in FIG. 15.

The double-head writing instrument 1 of the present embodiment is characterized in that the partition 3 is comprised of the vertical wall 35 the one end of which is connected with the side wall of the barrel 2 and extending in the longitudinal axis (i.e. vertical direction to the longitudinal axis) and the inclined wall 34 the one end of which is connected with the other end of the vertical wall 35 and the other end of which is connected with the side wall of the barrel 2.

The partition 3 is approximately the same in thickness. The inclined plane 341 is formed on both surfaces of the inclined wall 34 which corresponds the inner surface of the first ink reservoir 7A and the inner surface of the second ink reservoir 7B. The inclined plane 341 of the inclined wall 34 is a flat surface or a conical surface.

The first ink tank 5A is a transversely circular cylinder opened forward, and the bottom surface formed by the partition 3 is comprised of the inclined plane 341 and the vertical surface. The first ink-retaining member 6A is joined into the opening of the first ink tank 5A. The first ink reservoir 7A is formed inside the first ink tank 5A posterior to the first ink-retaining member 6A. Further, the second ink tank 5B is a transversely circular cylinder opened forward, and the bottom surface formed by the partition 3 is comprised of the inclined plane 341 and the vertical surface. The second ink-retaining member 6B is joined into the opening of the second ink tank 5B. The second ink reservoir 7B is formed inside the second ink tank 5B posterior to the second ink-retaining member 6B.

When the partition 3 is viewed from the opening of the first ink tank 5A, the inclined plane 341 is visually recognized at the part of the inclined wall 34 on the inner surface of the partition 3. Similarly, when the partition 3 is viewed from the opening of the second ink tank 5B, the inclined plane 341 is visually recognized at the part of the inclined wall 34 on the inner surface of the partition 3. Description regarding other compositions is omitted since they are the same as those explained in the first embodiment.

Seventh Embodiment

The sixth embodiment is illustrated in FIG. 16 to FIG. 19.

The double-head writing instrument 1 of the present embodiment is characterized in that the rear ends of the ink guiding cores 61A and 61B project posterior to those of the ink-retaining members 6A and 6B.

The first ink-retaining member 6A is a member for temporarily retaining ink spilled depending on an increase in pressure inside the first ink reservoir 7A and described as an injection molding of synthetic resins (for example, ABS resin) having a plurality of circular comb teeth in the present embodiment. The first nib 4A is provided on the front end of the first ink-retaining member 6A. The axial center aperture is provided through the axial center of the first ink-retaining member 6A and the first guiding core 61A is attached by insertion to the axial center aperture. The front end of the first guiding core 61A projects anterior to the front end of the first ink-retaining member 6A to give the first nib 4A, while the rear end of the first guiding core 61A projects posterior to the rear end of the first ink-retaining member 6A.

The first guiding core 61A may include a fiber modification, porous body or extrusion molding of synthetic resins with an axial capillary channel. The present embodiment is comprised of the core 611A made of an extrusion molding of soft synthetic resin such as polyester elastomer and the outer covering part 612A made of hard synthetic resins such as polyacetal resin covering the outer circumference of the core 611A. In the front end of the first guiding core 61A, the core 611A and the outer covering part 612A are ground into a brush form and the capillary channel of the core 611A is exposed outside to give a brush tip.

Further, in the rear end of the first guiding core 61A, the core 611A and the outer covering part 612A are ground, and the capillary channel of the core 611A is exposed in the outer radial direction. Where the first nib 4A is pointed upward (refer to FIG. 16), the rear end of the first guiding core 61A is immersed into the first ink 8A, the rear end of the first guiding core 61A is positioned posterior to the level of the first ink 8A (lower position), and the rear end of the first guiding core 61A is in contact with the first ink 8A. An axial distance between the rear end of the first guiding core 61A and the level of the first ink 8A is preferably 0.5 mm or greater (more preferably 1 mm or greater), because the ink can be sufficiently supplied to the first guiding core 61A, even when the nib is pointed upward. When the first nib 4A is pointed upward (refer to FIG. 17), the rear end of the second guiding core 61B is in contact with the second ink 8B also when the second nib 4B is pointed downward.

The second ink-retaining member 6B is a member for temporarily retaining ink spilled depending on an increase in pressure inside the second ink reservoir 7B and as an injection molding of synthetic resins (for example, ABS resin) having a plurality of circular comb teeth in the embodiment. The second nib 4B is provided on the front end of the second ink-retaining member 6B. The axial center aperture is provided through the axial center of the second ink-retaining member 6B and the second guiding core 61B is attached by insertion into the axial center aperture. The front end of the second guiding core 61B projects anterior to the front end of the second ink-retaining member 6B to give the second nib 4B, while the rear end of the second guiding core 61B projects posterior to the rear end of the second ink-retaining member 6B.

The second guiding core 61B may include a fiber modification, a porous body or an extrusion molding of synthetic resins with an axial capillary channel. The present embodiment is comprised of the core 611B made of an extrusion molding of soft synthetic resins such as polyester elastomer and the outer covering part 612A made of soft synthetic resin such as polyacetal resin covering the outer circumference of the core 611B. In the front end of the second guiding core 61B, the core 611B and the outer covering part 612B are ground into a brush form and the capillary channel of the core 611B is exposed outside to give a brush tip.

Further, in the rear end of the second guiding core 61B, the core 611B and the outer covering part 612B are ground and the capillary channel of the core 611A is exposed in the outer radial direction. Where the second nib 4B is pointed upward (refer to FIG. 18), the rear end of the second guiding core 61B is immersed into the second ink 8B, the rear end of the second guiding core 61B is positioned posterior to the level of the second ink 8B (lower position), and the rear end of the second guiding core 61B is in contact with the second ink 8B. An axial distance between the rear end of the second guiding core 61B and the level of the second ink 8B is preferably 0.5 mm or greater (more preferably 1 mm or greater), because the ink can be sufficiently supplied to the second guiding core 61B, even when the nib is pointed upward. When the second nib 4B is pointed upward (refer to FIG. 18), the rear end of the first guiding core 61A is in contact with the first ink 8A also when the first nib 4A is pointed downward.

Figure 20:
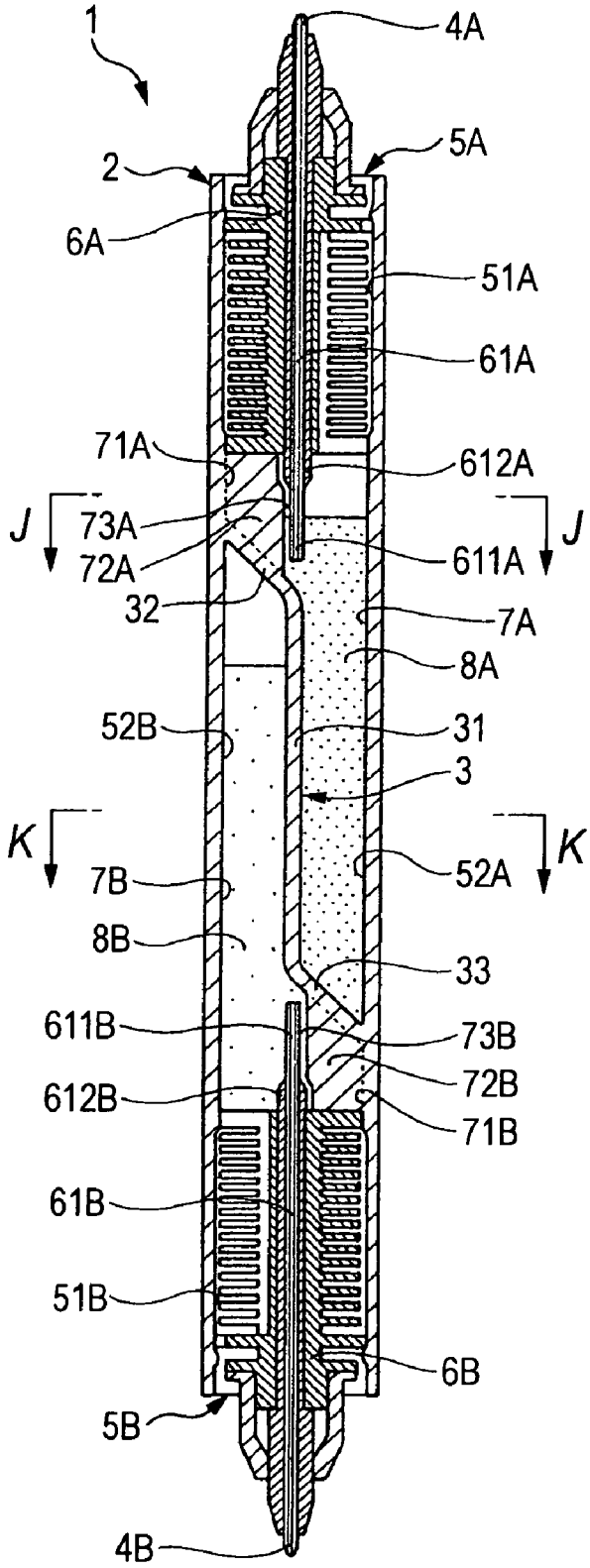
FIG. 20 is a longitudinal sectional view showing the double-head writing instrument of the eighth embodiment according to the present invention, with the first nib pointed upward.
Figure 21:
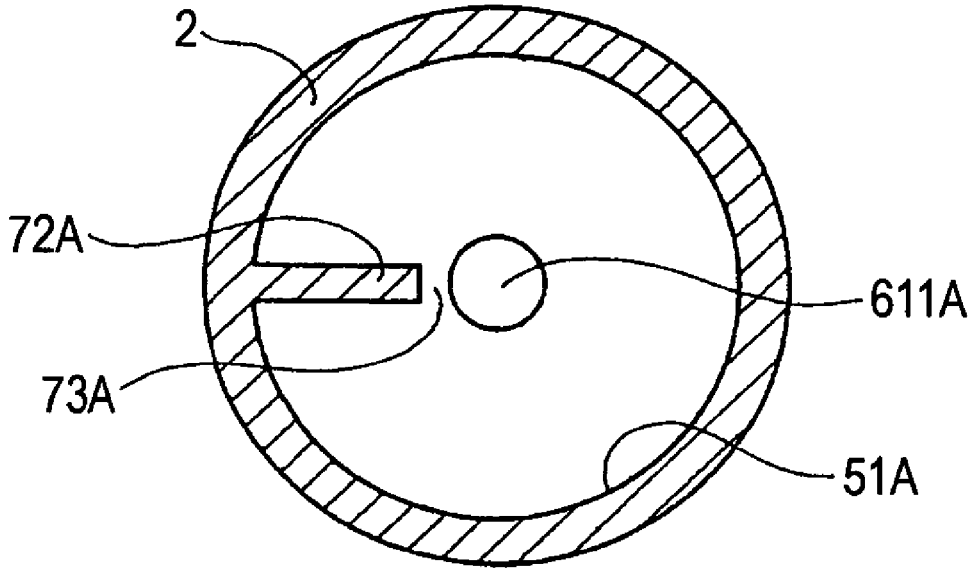
FIG. 21 is an enlarged sectional view taken along line J-J in FIG. 20.
Figure 22:
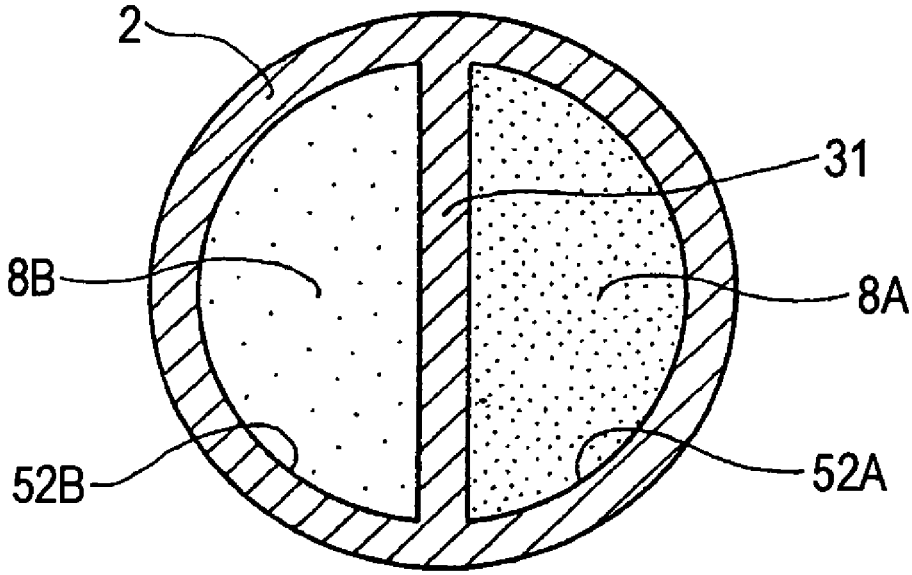
FIG. 22 is an enlarged sectional view taken along line K-K in FIG. 20.
Figure 23:
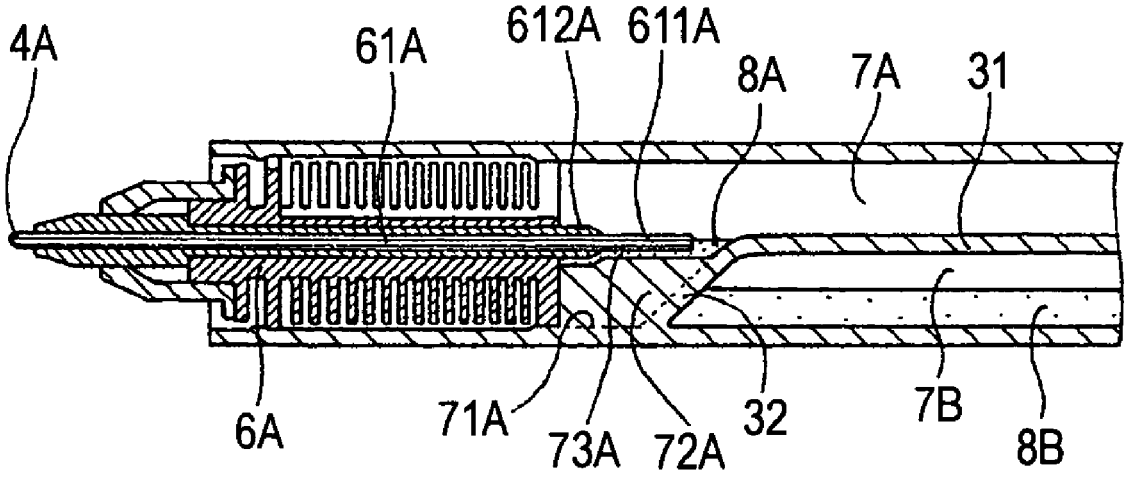
FIG. 23 is a longitudinal sectional view illustrating the first nib kept horizontal in FIG. 20.

The first concave space 71A is formed in a vertically concave shape by the first bottom wall 32, the rear end surface of the first ink-retaining member 6A and the side wall of the barrel 2 therebetween. The rear end of the first guiding core 61A is positioned inside the first concave space 71A. Further, the rear end of the first guiding core 61A is positioned posterior to the front end of the first bottom wall 32 in a slanted manner and anterior to the rear end of the first bottom wall 32 extended in a slanted manner. Whereby the rear end of the first guiding core 61A is made closer to the first bottom wall 32 and the rear end of the first ink guiding core 61A is allowed to project backward to the longest possible amount.

Where the first ink 8A of the first ink reservoir 7A remains in a small quantity and even when the double-head writing instrument 1 is held horizontal (refer to FIG. 20) or the first nib 4A is pointed obliquely upward, the first ink 8A can be kept inside the first concave space 71A by allowing the first concave space 71A to point downward, a condition where the first ink 8A is in contact with the rear end of the first guiding core 61A can be maintained, thereby making it possible to supply the first ink 8A to the capillary channel of the first guiding core 61A, and to use a writing instrument free from ink flow failure.

Similarly, the second concave space 71B is formed by the second bottom wall 33, the rear end surface of the second ink-retaining member 6B and the side wall of the barrel 2 therebetween. The rear end of the second guiding core 61B is positioned inside the second concave space 71B. Further, the rear end of the second guiding core 61B is positioned posterior to the front end of the second bottom wall 33 extended in a slanted manner but anterior to the rear end of the second bottom wall 33 extended in a slanted manner. Whereby the rear end of the second guiding core 61B is made closer to the second bottom wall 33 and the rear end of the second ink guiding core 61B is allowed to project backward to the longest possible amount.

Where the second ink 8B of the second ink reservoir 7B remains in a small quantity and even when the double-head writing instrument 1 is held horizontally or the second nib 4B is pointed obliquely upward, the second ink 8B can be kept inside the second concave space 71B by allowing the second concave space 71B to point downward, a condition where the second ink 8B is in contact with the rear end of the second guiding core 61B can be maintained, thereby making it possible to supply the second ink 8B to the capillary channel of the second guiding core 61B, and to use a writing instrument free from ink flow failure.

In the present embodiment, the first ink 8A (black or black Indian ink) is filled into the first ink reservoir 7A and the second ink 8B (gray or gray Indian ink) is filled into the second ink reservoir 7B.

Description regarding other compositions is omitted since they are the same as those explained in the first embodiment.

Eighth Embodiment

The eighth embodiment is illustrated in FIG. 20 to FIG. 23.

The double-head writing instrument 1 of the present embodiment is characterized in that the ribs 72A and 72B are provided on the concave spaces 71A and 71B.

The first rib 72A extending in the longitudinal axis is formed integrally on the inner surface of the side wall of the barrel 2 and the first bottom wall 32 constituting the first concave space 71A. The clearance 73A having capillary force is formed between the first rib 72A and the outer circumferential surface of the rear end of the first guiding core 61A. Even when the first ink 8A of the first ink reservoir 7A remains in a small quantity, the clearance 73A makes it possible to supply the ink to the rear end of the first guiding core 61A without fail. As a result, the first ink 8A of the first ink reservoir 7A can be used completely.

Similarly, the second rib 72B extending in the longitudinal axis is provided integrally on the inner surface of the side wall of the barrel 2 and the second bottom wall 33 constituting the second concave space 71B. The clearance 73B having capillary force is formed between the second rib 72B and the outer circumferential surface of the rear end of the second guiding core 61B. Even when the second ink 8B of the second ink reservoir 7B remains in a small quantity, the clearance 73B makes it possible to supply the ink to the rear end of the second guiding core 61B without fail. As a result, the first ink 8B of the second ink reservoir 7B is used completely.

Further, description regarding other compositions is omitted since they are the same as those explained in the seventh embodiment.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A double-head writing instrument, comprising:

a barrel formed by injection molding of transparent synthetic resin, the barrel opened at first and second ends thereof, the barrel having a partition formed therein;

first and second ink-tanks provided inside the barrel and defined by the barrel and the partition so as not to communicate each other, the first and second ink-tanks opened at the first and second ends of the barrel, respectively;

a first ink-retaining member connected with a first nib provided on an opening of the first ink-tank;

a first ink reserved inside a first ink-reservoir which is provided inside the first ink-tank and at rear of the first ink-retaining member;

a second ink-retaining member connected with a second nib provided on an opening of the second ink-tank; and a second ink reserved inside a second ink-reservoir which is provided inside the second ink-tank and at rear of the second ink-retaining member, wherein the first and second ink-retaining members retain temporarily the first and second ink spilled in accordance with an increase in pressure inside the first and second ink-reservoirs, respectively, the partition is extended in an axial direction of the writing instrument so as that the first and second ink-reservoirs overlap each other in a radial direction, and thickness C of the partition and thickness D of a side wall of the barrel connected with the partition satisfy a relation of $0.2 \leqq C/D \leqq 2.5$, wherein inclined surfaces slanting relative to the axial direction are provided on an inner surface of the partition on the first ink-reservoir side and second ink-reservoir sides, respectively.

2. The double-head writing instrument as set forth in claim 1, wherein one end of the partition is connected with the side wall of the barrel in a vicinity of the first ink-retaining member and the other end of the partition is connected with the side wall of the barrel in a vicinity of the second ink-retaining member.

3. The double-head writing instrument as set forth in claim 1, wherein the partition comprises:

a central wall extending in the axial direction; and bottom walls connected with both ends of the central wall and also with the side wall of the barrel, the bottom walls slanting relative to the axial direction.

4. The double-head writing instrument as set forth in claim 1, wherein the inclined surfaces are visually confirmed almost over entire partitions, when the partition is viewed from the opening of the first ink-tank and also when viewed from the opening of the second ink-tank.

5. A double-head writing instrument, comprising:

a barrel opened at first and second ends thereof, the barrel having a partition integrally formed therein;

first and second ink-tanks provided inside the barrel, defined by the barrel and the partition so as not to communicate each other, and opened at the first and second ends of the barrel;

a first ink-retaining member connected with a first nib provided on an opening of the first ink-tank;

a first ink reserved inside a first ink-reservoir which is provided inside the first ink-tank at rear of the first ink-retaining member;

a second ink-retaining member connected with a second nib provided on an opening of the second ink-tank; and a second ink reserved inside a second ink-reservoir which is provided inside the second ink-tank at rear of the second ink-retaining member, wherein the first and second ink-retaining members retain temporarily the first and second ink spilled in accordance with an increase in pressure inside the first and second ink-reservoirs, respectively, inclined surfaces slanting relative to an axial direction of the writing instrument are provided on an inner surface of the partition on the first ink-reservoir side and second ink-reservoir side, respectively.

6. The double-head writing instrument as set forth in claim 5, wherein one end of the partition is connected with a side wall of the barrel in a vicinity of the first ink-retaining member, and the other end of the partition is connected with the side wall of the barrel in a vicinity of the second ink-retaining member.

7. The double-head writing instrument as set forth in claim 5, wherein the partition comprises:

a central wall extending in the axial direction and a bottom wall connected with both ends of the central wall and also with the side wall of the barrel and slanting toward the axial direction.

8. The double-head writing instrument as set forth in claim 5, wherein the inclined surfaces are visually confirmed almost over entire partitions, when the partition is viewed from the opening of the first ink-tank and also when viewed from the opening of the second ink-tank.

* * * * *